US007758358B1

(12) United States Patent
Mier-Langner et al.

(10) Patent No.: US 7,758,358 B1
(45) Date of Patent: Jul. 20, 2010

(54) TRACK LIGHTING ASSEMBLY

(75) Inventors: Alejandro Mier-Langner, Providence, RI (US); Julia Fishman, Cranston, RI (US); James Kuchar, Fall River, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 51 days.

(21) Appl. No.: 12/114,979

(22) Filed: May 5, 2008

(51) Int. Cl.
*H01R 25/00* (2006.01)

(52) U.S. Cl. ..... 439/115; 362/219; 362/648

(58) Field of Classification Search ..... 439/111, 439/115, 119, 121, 210, 213; 362/219, 648
See application file for complete search history.

(56) References Cited

U.S. PATENT DOCUMENTS 1,830,355 A 11/1931 Farr
1,885,513 A 11/1932 Mask
2,026,884 A 1/1936 Glasgow
2,220,220 A 11/1940 Cusimano
2,856,592 A 10/1958 Carlson
2,946,037 A 7/1960 Platz et al.
2,967,230 A 1/1961 Goetz et al.
3,120,985 A 2/1964 Hubbell
3,246,135 A 4/1966 Husby
3,273,103 A 9/1966 Ericson
3,303,336 A 2/1967 Husby
3,391,337 A 7/1968 Corl et al.
3,529,275 A 9/1970 Routh
3,559,146 A 1/1971 Valtonen
3,622,938 A 11/1971 Ito et al.
3,646,501 A 2/1972 Valtonen
3,686,614 A 8/1972 Hyrylainen
3,718,886 A 2/1973 Hoffmeister
3,757,273 A 9/1973 Hesse
3,760,133 A 9/1973 Howard
3,832,503 A 8/1974 Crane
3,832,673 A 8/1974 Le Hir
3,848,715 A 11/1974 Hesse
3,871,730 A * 3/1975 Hesse ..... 439/115
3,884,541 A 5/1975 O'Nan et al.
3,894,781 A 7/1975 Donato
3,933,403 A 1/1976 Rubesamen et al.
3,980,368 A 9/1976 Fremont
3,993,385 A 11/1976 Seger
4,029,378 A 6/1977 Bolis
4,032,208 A 6/1977 Berkenhoff
4,053,194 A 10/1977 Gilman
4,085,988 A 4/1978 Gamble
4,108,523 A 8/1978 Bolis
4,139,252 A 2/1979 Gorny
4,139,525 A 2/1979 Bacskai
4,181,388 A 1/1980 Donato
4,200,862 A 4/1980 Campbell et al.
4,211,460 A 7/1980 Seelbach et al.
4,218,108 A 8/1980 El Mouchi
4,236,194 A 11/1980 Norman
4,289,365 A 9/1981 Rutgers
4,375,106 A 2/1983 Voll
4,380,792 A 4/1983 Terrell
4,392,187 A 7/1983 Bornhorst (Continued)

*Primary Examiner*—Tho D Ta

(57) ABSTRACT

A track lighting assembly includes a coupler to join tracks which is movable through a plurality of angles. The assembly also comprises an adapter which allows for flush mounting of the track wherein the fixture adapters may be moved along the track despite the flush mounting of the track.

21 Claims, 18 Drawing Sheets

U.S. PATENT DOCUMENTS 4,508,400 A 4/1985 Herbert
4,533,190 A 8/1985 Booty
4,557,547 A 12/1985 Stuart
4,598,345 A 7/1986 Kleeman
4,655,520 A 4/1987 Cummings
4,676,567 A 6/1987 Mouchi
4,684,822 A 8/1987 Angott
4,699,439 A 10/1987 Cohen
4,712,167 A 12/1987 Gordin et al.
4,722,030 A 1/1988 Bowden
4,727,460 A 2/1988 Payne
4,779,168 A 10/1988 Montgomery
4,790,766 A 12/1988 Booty, Sr. et al.
4,797,795 A 1/1989 Callahan
4,822,292 A 4/1989 Thayer et al.
4,861,273 A 8/1989 Wenman et al.
4,887,196 A 12/1989 Brown et al.
4,931,917 A 6/1990 Scherf et al.
4,947,302 A 8/1990 Callahan
4,968,262 A 11/1990 Widell et al.
4,979,081 A 12/1990 Leach et al.
5,013,251 A 5/1991 Stringer et al.
5,031,082 A 7/1991 Bierend
5,038,261 A 8/1991 Kloos
5,055,746 A 10/1991 Hu et al.
5,072,216 A 12/1991 Grange
5,151,037 A 9/1992 Range et al.
5,151,038 A 9/1992 Range et al.
5,176,442 A 1/1993 Richardson
5,192,126 A 3/1993 Remeyer et al.
5,209,560 A 5/1993 Taylor et al.
5,329,431 A 7/1994 Taylor et al.
5,336,097 A 8/1994 Williamson, Jr. et al.
5,336,100 A * 8/1994 Gabrius et al. ..... 439/115
5,347,431 A 9/1994 Blackwell et al.
5,382,947 A 1/1995 Thaler et al.
5,406,176 A 4/1995 Sugden
5,502,627 A 3/1996 Hunt et al.
5,506,715 A 4/1996 Zhu
5,517,391 A 5/1996 Grau
5,526,245 A 6/1996 Davis et al.
5,554,979 A 9/1996 Kohar et al.
5,593,224 A 1/1997 Kunkel et al.
5,593,244 A 1/1997 Kunkel et al.
5,637,964 A 6/1997 Hakkarainen et al.
5,695,279 A 12/1997 Sonnleitner et al.
D389,460 S 1/1998 Wei-Hong
5,731,664 A 3/1998 Posa
5,769,531 A 6/1998 Hunt et al.
5,803,755 A 9/1998 Kuchar et al.
D399,594 S 10/1998 Patik
5,833,358 A 11/1998 Patik
5,855,485 A 1/1999 Patti
5,921,659 A 7/1999 Hunt et al.
5,938,362 A 8/1999 Bastiansen
5,988,838 A 11/1999 Rudenberg
5,989,067 A 11/1999 Morgan et al.
6,004,005 A 12/1999 Demshki, Jr.
6,032,432 A 3/2000 Patti
6,079,992 A 6/2000 Kuchar et al.
6,095,669 A 8/2000 Cho
6,120,262 A 9/2000 McDonough et al.
6,127,925 A 10/2000 Bonsignore et al.
6,130,412 A 10/2000 Sizemore
6,163,275 A 12/2000 Hartzell
6,169,377 B1 1/2001 Bryde et al.
6,174,073 B1 1/2001 Regan et al.
6,192,282 B1 2/2001 Smith et al.
6,220,721 B1 4/2001 Chan et al.
6,273,578 B1 8/2001 Lai
6,273,587 B1 8/2001 Demshki
6,296,498 B1 * 10/2001 Ross ..... 439/115
6,312,140 B1 11/2001 McGuire
6,530,791 B1 * 3/2003 Hierzer ..... 439/115
6,567,032 B1 5/2003 Mullaly et al.
6,616,465 B1 9/2003 Fontana et al.
RE38,259 E 10/2003 Kuchar et al.
6,655,817 B2 12/2003 Devlin et al.
6,687,487 B1 2/2004 Mosebrook et al.
7,018,072 B2 3/2006 Mier-Langner et al.
7,024,119 B1 4/2006 Mier-Langner et al.
7,027,736 B1 4/2006 Mier-Langner et al.
7,092,257 B2 8/2006 Westerheide
7,111,957 B2 9/2006 Bornhart et al.
7,137,727 B2 11/2006 Joseph et al.
2001/0040805 A1 11/2001 Lansing et al.
2004/0005798 A1 1/2004 Lin
2004/0218395 A1 11/2004 Westerheide
2007/0115694 A1 * 5/2007 Mobarak et al. ..... 362/648
2007/0153509 A1 * 7/2007 Lehman et al. ..... 362/219

* cited by examiner

TRACK LIGHTING ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a track lighting assembly. More specifically a fixture adapter usable with a flush mount track as well as a variable angle coupler for the track lighting assembly.

2. Description of the Related Art

Electrical track lighting systems utilizes longitudinally extending track structure having rails, conductors or bus bars which are engaged by contacts or blades on a fixture adapter. The adapter and the light fixture depending from the adapter are generally slidable along the longitudinally extending track, and maintain contact with the rails, conductors or bus bars in order to provide power to the light at a plurality of positions along the length of the track.

Both line voltage track systems and low voltage track systems are widely used in commercial and residential applications, because of the flexibility that they offer to position and to reposition light fixtures. Line voltage systems typically operate at 120 volts AC, while low voltage systems typically operate at 12 or 24 volts. Line voltage track systems have the advantage of longer run lengths and greater choice of lamp options. Alternatively, low voltage track lighting systems have an advantage of being bendable in the field, allowing for architectural curves and also accommodating ceiling obstructions. Low voltage lamps have the advantage of also reducing energy costs. It may be desirable to provide a track lighting system that combines the advantages of the line voltage systems with the advantages of the low voltage systems.

One problem with existing fixture adapters is the connection of the fixture adapter to the lighting track. Tracks may be flush mounted against the ceiling surface, slightly spaced from the ceiling, or suspended some distance from the ceiling using stems or cables. Flush mounted tracks decrease the visual interference of the track assembly within the room where the track lighting system is utilized. However, many fixture adapters are connected to the tracks with structure that surrounds the entire track, or at least extends over and above the track in order to maintain proper contact with the bus bars and provide power to the light fixture. When such fixture adapter is utilized, a track may not be flush mounted with the ceiling, because the fixture adapter will interfere with the ceiling surface, and therefore may not be moveable along the length of the track. Accordingly, there is need for an improved track lighting system which overcomes such deficiency.

Additionally, some track lighting is constructed of materials which allow the track to be bendable into curvilinear lengths and provide various designs for the track lighting system. Even these materials have limits to which they can be bent without breaking. However, many lighting designs require sharper angles or turns than may be provided by these track materials. Thus, it is desirable to provide a coupler structure which allows a first track to be positioned at a plurality of angles relative to the second track without bending of the tracks to a degree which may cause breakage of the track material.

Given the foregoing, it will be appreciated that a track lighting system is desirable which allows variable angle coupling and additionally which may be flush mounted to a ceiling while still allowing for movement of the fixture adapter.

SUMMARY OF THE INVENTION

A track lighting assembly, comprising a first track member, a second track member, a coupler positioned between the first track member and the second track member, the coupler having a first trackway for receiving a first track member and a second trackway for receiving a second track member, the coupler having a first side adjacent a first side of the first and second track members, a second side adjacent a second side of the first and second track members and a lower side disposed along a lower surface of the first and second track members, wherein the upper portion of the coupler is open allowing the track members to have various structural shapes. The track lighting assembly wherein the coupler has a joint disposed between a first connector and a second connector of the coupler allowing pivotal motion between the first track member and the second track member. The track lighting member wherein the coupler allows rotation between the first track member and the second track member of between about 60 degrees and about 300 degrees. The track lighting assembly wherein the coupler further comprises first and second offset blades in the vertical direction. The track lighting assembly wherein the joint further comprises a plurality of circular leads in electrical communication with blades within the first housing and the second housing. The track lighting assembly further comprising two of the circular leads engaging for each of a hot circuit, neutral circuit and a ground circuit. The track lighting assembly wherein the hot circuit, the neutral circuit and the ground circuit are at different elevations within the trackway. The track lighting assembly wherein the first and second housings each have a housing cover including an open upper area. The track lighting assembly wherein the first and second housings have keys for insertion of the first track and the second track members in a preselected orientation. The track lighting assembly wherein the coupler further comprises a ground blade. The track lighting assembly wherein the first trackway and the second trackway are substantially U-shaped. The track lighting assembly wherein an upper surface of each the first and second track members is substantially flush with an upper surface of the coupler. The track lighting assembly wherein the coupler further comprises a pivot assembly. The track lighting assembly wherein the pivot assembly provides a range of motion between the first track member and the second track member of between about 60 degrees and about 300 degrees. The track lighting assembly wherein the pivot assembly is wire-free. The track lighting assembly wherein the pivot assembly further comprises a wireless electrical junction for each of the three circuits. The track lighting assembly wherein the coupler is a rigid straight orientation between the first track member and the second track member. The track lighting assembly wherein the track members each have vertically offset bus bars.

A coupler for a track lighting assembly comprises a first housing and a second housing, a joint disposed between the first housing and the second housing, the first housing having a first trackway and the second housing having a second trackway, the joint having a wireless electrically conductive rotatable assembly therein for electrical communication between the first housing and the second housing, the first housing movable relative to the second housing about an axis extending through the joint. Each of the first trackway and the second trackway comprise at least one key. The coupler wherein at least one key being a first key and a second key. The coupler wherein the first key and the second key are offset in a vertical direction. The coupler further comprising a hot blade, a neutral blade and a ground blade. The coupler wherein the ground blade is disposed for contact with a track cap.

A coupler for a track lighting assembly comprising a first track housing, a second track housing pivotally coupled to the first track housing by an electrically conductive joint, the first and second housings having a hot conductive circuit, a neutral conductive circuit and a ground conductive circuit, at least one blade corresponding to each of the circuits in each of the housings, the blades being vertically offset for maintaining proper polarity across the coupler.

A fixture adapter for use with a track lighting system comprising an adapter housing, a trackway disposed in the adapter housing for receiving the track, the trackway having a first blade, a second blade and a third blade being vertically offset from one another, the track having an interchangeable upper cap, the adapter housing extending upwardly along first and second sides of the track to a position that is one of equal to or beneath the upper edge of the track.

A fixture adapter for use with a track lighting assembly, comprising a fixture adapter housing having a first clamp portion and a second clamp portion which define a trackway for receiving lighting track, a clamp fastener for opening and closing the clamping structure which engages the track, each of the first clamp portion and second clamp portion having at least one blade, the blades of the first clamp portion and the second clamp portion being vertically offset, the trackway having an open upper area, the lighting track having a track body and a removable upper cap which is one of flush with the fixture adapter housing or extends above the fixture adapter housing. The fixture adapter wherein the first fixture adapter housing has a contact holder positioned therein. The fixture adapter wherein the second clamp housing has a second contact holder positioned therein and seated within the first contact holder. The fixture adapter further comprising a ground contact positioned on the first contact holder and within the first housing. The fixture adapter wherein the second contact holder is slidably received by the first contact holder. The fixture adapter wherein the clamp knob extends through the first clamp housing the first contact holder, the second contact holder, and the second clamp housing and threadably engaging a threaded insert disposed within the second clamp housing.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
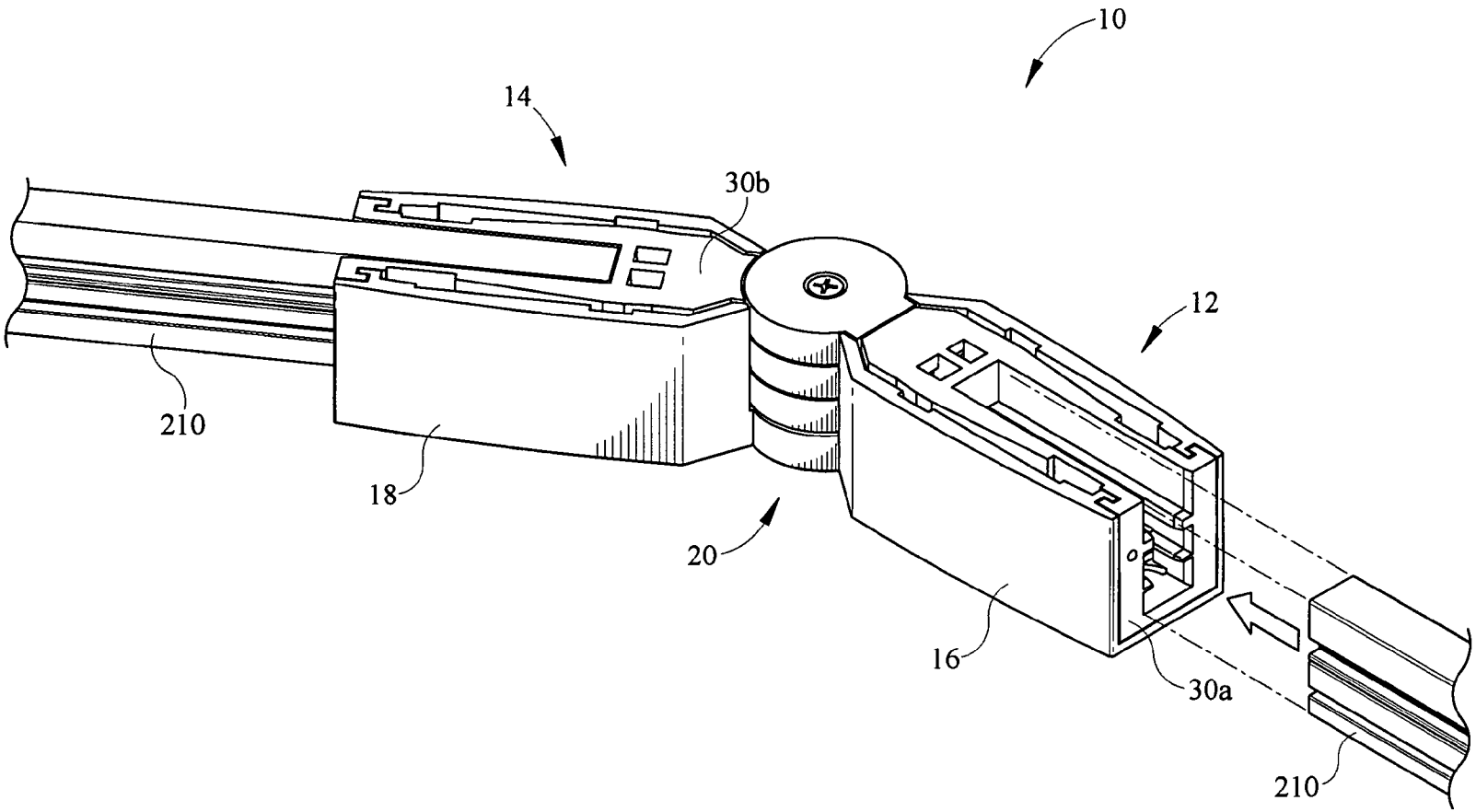
FIG. 1 is a perspective view of a variable angle coupler connected to a first track and a second track moving toward engagement with the coupler.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout the several views, there are shown in FIGS. 1-18 various aspects of a track lighting system. Specifically, the track lighting system utilizes a variable angle coupler having a conductive joint allowing rotation of a first coupled track of the track lighting system relative to a second track wherein the joint is a wireless pivoting connection. The track lighting system also utilizes a fixture adapter which does not extend above or beyond the top edge of the track so that the track may be flush mounted if desired while still allowing for movement of the fixture adapter, and fixture, without interference with the ceiling.

Referring now to FIG. 1, a perspective view of a variable angled coupler 10 is depicted. The coupler 10 is connected at one end to a lighting track. At a second opposite end, a lighting track is moving toward the coupler 10 for engagement. The coupler 10 has a first track connector 12 and a second track connector 14. Each of the first and second track connectors 12, 14 comprise a corresponding housing 30*a*, 30*b* and a corresponding housing cover 16, 18, respectively. An electrically conductive joint 20 is disposed between the first connector 12 and the second connector 14 proving electrical communication across the coupler 10 from the first track connector 12 to the second track connector 14. First and second lighting tracks 210 (FIG. 12) are positioned within the first and second track connectors 12, 14, respectively, to provide electrical communication between the tracks and to allow pivotal motion of the first and second tracks through a range of angles from between about 60 degrees to about 300 degrees. Accordingly, the coupler 10 is a variable angle coupler, and allows relative movement between the first and second track sections at angles or within a linear distance which would otherwise break a single track if bent.

Figure 2:
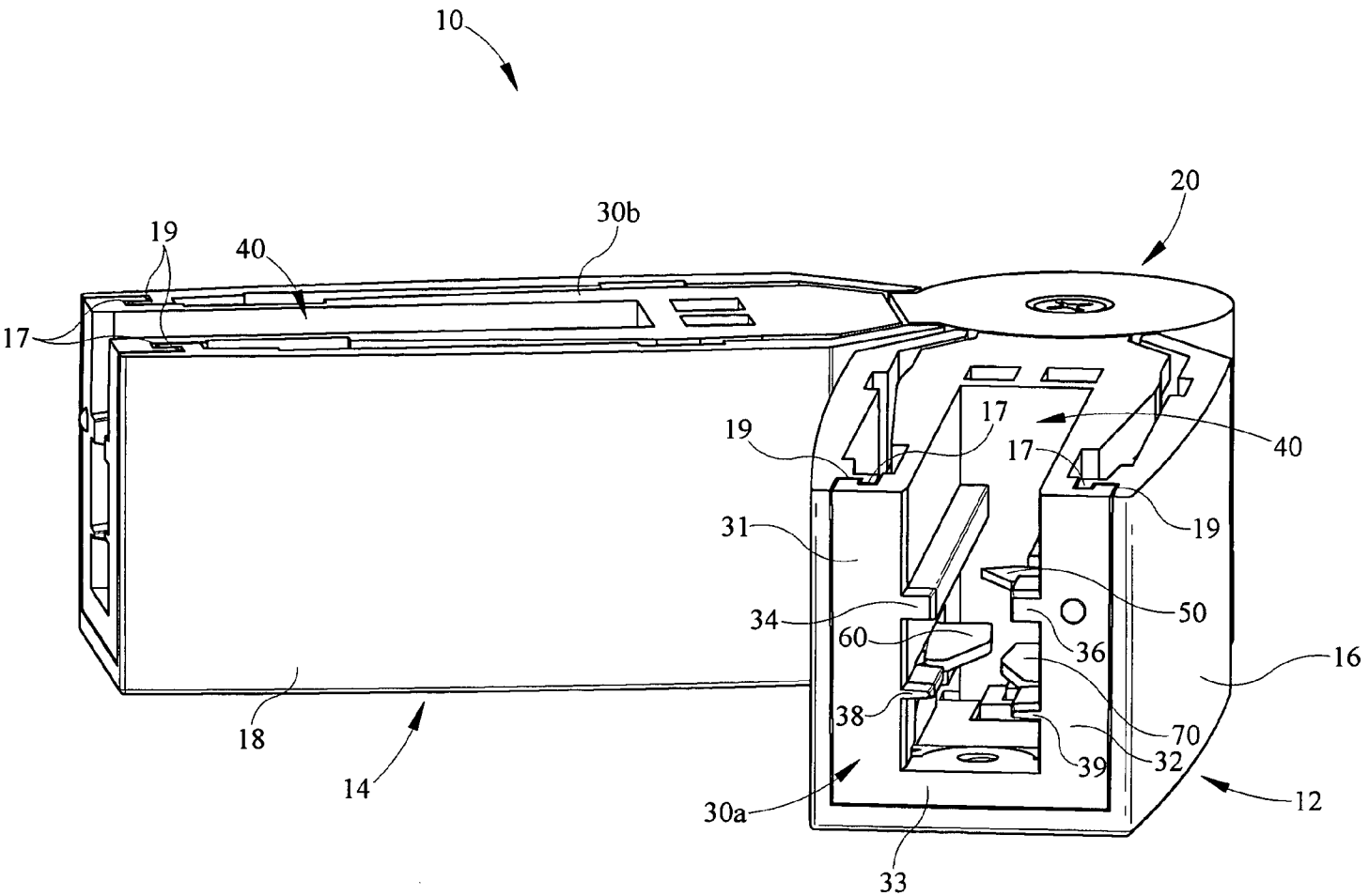
FIG. 2 is a perspective view the variable angle coupler of FIG. 1 in a second position.

Referring now to FIG. 2, the variable angle coupler 10 is depicted again in perspective view with the first and second connectors 12, 14 positioned at about 70 degrees relative to one another. The angle is measured along a centerline of each connector 12, 14 which extends through the joint 20. The first connector 12 is oriented for viewing at an end thereof. The housing covers 16, 18 are substantially U-shaped and have an open upper area which receives the housings 30*a*, 30*b* respectively. The housings 30*a*, 30*b* are substantially similar and therefore only one housing will be described. The outer surface of the housing covers 16, 18 are angled or tapered near the joint 20 to provide additional clearance for rotation of one housing cover relative to the other housing cover without interference.

The housing 30*a* is also substantially U-shaped as shown in the end view, having a first wall 31, an opposed second wall 32, and a lower wall 33 each extending toward joint 20. The housings 30*a*, 30*b* each comprise an opening or trackway 40 extending from ends of the housing away from the joint 20 towards the center of the housing, near the joint 20. Each trackway 40 receives a track, for example 210, 310, 410 (FIGS. 10, 14, 15), into each of the connectors 12, 14 for electric coupling and pivotal motion between the coupled tracks. The housing covers 16, 18 each comprise vertically orientated keys 17, and keyways 19, which receive opposed keys and keyways of the housings 30*a*, 30*b*. The first and second walls 31, 32 each comprise at least one key extending from an outermost end of the housings 30*a*, 30*b* toward the central portion of the coupler 10 near the joint 20.

Figure 12:
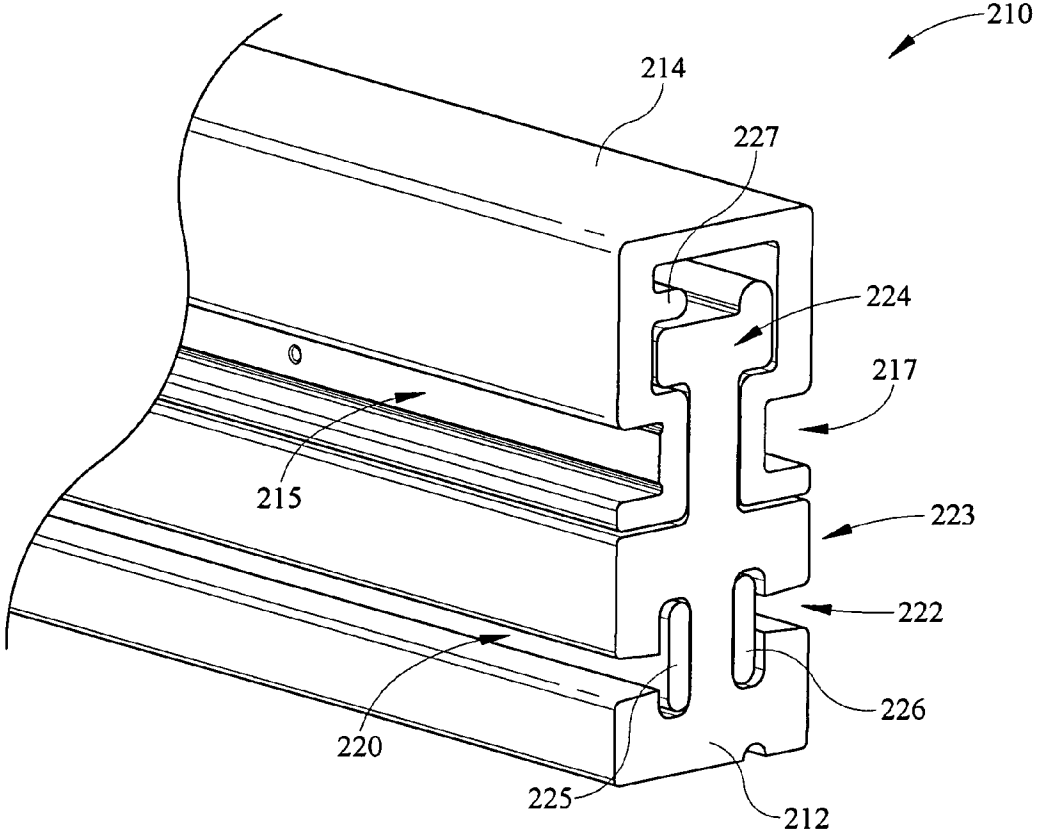
FIG. 12 is a detail perspective view of the end of the lighting track, with the end cap removed.

In the exemplary embodiment, each trackway 40 comprises four keys, 34, 36, 38 and 39. The first and second keys 34, 36 are oppositely positioned on the first wall 31 and second wall 32. The first key 34 is generally square shaped, but may be selected from any variety of shapes which correspond to a cross-section of a groove in the track 210 (FIG. 12) positioned within the housings 30*a*, 30*b*. The second opposite key 36 extends from the opening or trackway 40, and is interrupted in its path toward the joint 20 by a ground blade 50. The ground blade makes contact with a track 210 (FIG. 12). Thus the track lighting system accessories are grounded by way of the track which is connected to ceiling adapters 202 (FIGS. 8, 9), which are in turn connected to the structure of the building in which the track lighting system 200 (FIG. 8) is utilized.

Beneath the key 34 on the first wall 31 is a third key 38. The third key 38 extends in a direction from the trackway 40 opening toward the joint 20 with a contact or blade 60. In the exemplary embodiment, the blade 60 corresponds to the hot circuit of the track lighting system. Positioned on the opposite wall 32, is an additional contact or blade 70 corresponding to the neutral circuit of the track lighting system. The location of the blades 50, 60, 70 may be changed and should not be considering limiting as long as the polarity is maintained constant across the coupler 10 from the first connector 12 to the second connector 14. In order to maintain consistent polarity, the key 39 which is aligned with blade 70, is offset in a vertical direction from the key 38 and blade 60. This offset provides that the proper polarity is maintained from the first track to a second track when the coupler 10 is utilized, and further inhibits the tracks from being positioned within the coupler 10 in such a way which might cross the polarities and short circuit the track system.

Figure 3:
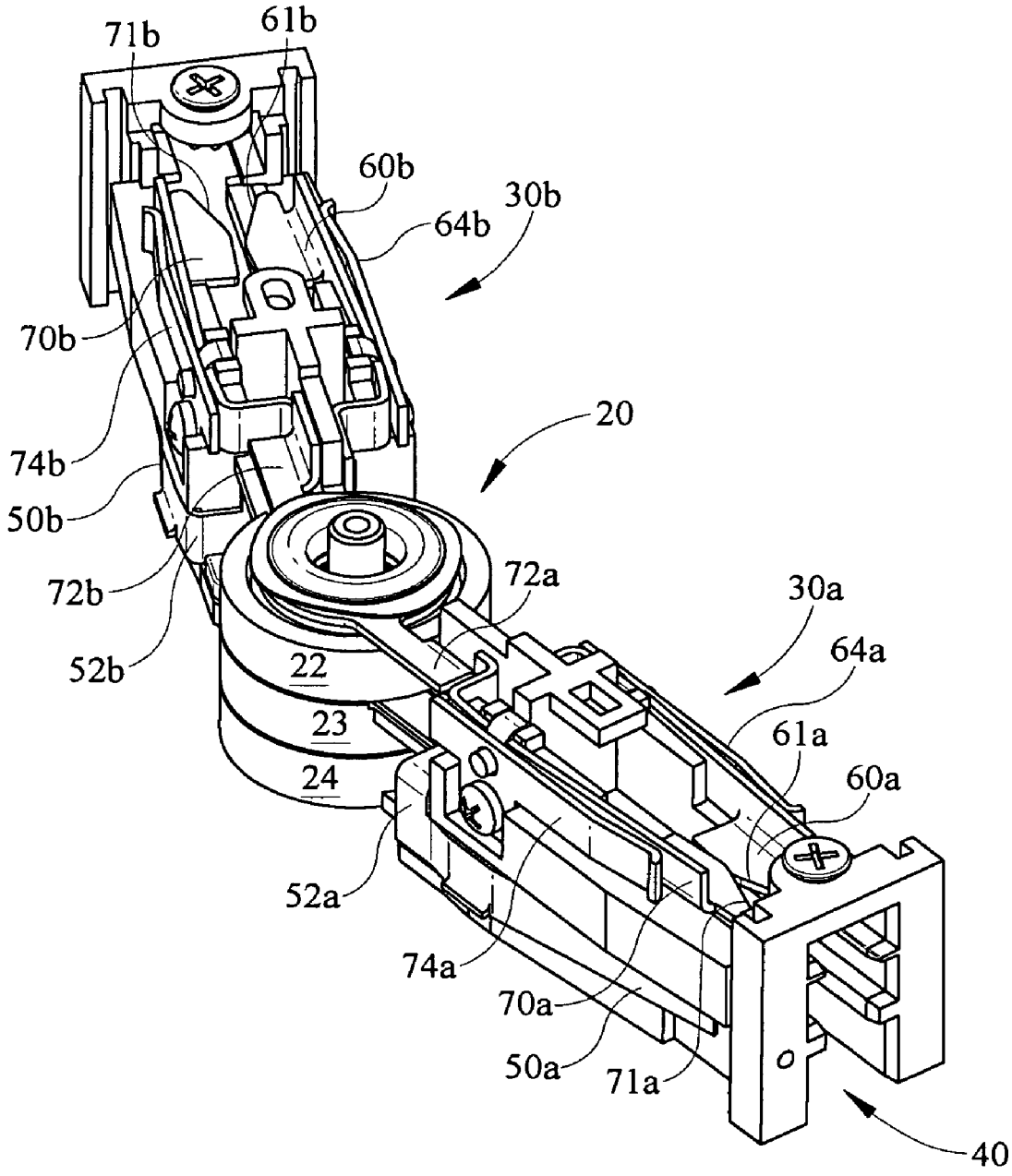
FIG. 3 is a perspective view of the variable angle coupler housing with the cover removed.

Referring now to FIG. 3, the housings 30*a*, 30*b* are depicted with the covers 16, 18 removed and in a different angular position then shown in FIG. 2. The housings 30*a*, 30*b* are rotated upside-down, and depict the hot and neutral blades 70*a*, 60*a*, 70*b*, 60*b*. Each of the blades 60, 70 comprises a tapered blade edge 71*a*, 61*a*, 71*b*, 61*b*, which provide a lead-in for contact with bus bars 225, 226 on the tracks 210 (FIG. 1) connected to the coupler 10. The blades 70*a*, 70*b* each comprise a lead 72*a*, 72*b* extending into the joint area 20. The leads 72*a*, 72*b* maintain contact with one another in electrical communication in the various rotated positions of the connectors 12, 14. This electrical communication between ends of the blades 50, 60, 70 is maintained across the joint 20. Thus, at any angular position between the two housings 30*a*, 30*b*, electricity may be conducted across the coupler 10 along this circuit. The other circuits also operate similarly. Adjacent the blades 70*a*, 70*b* are helper springs 74*a*, 74*b*. The springs 74*a*, 74*b* are fastened to the housings 30*a*, 30*b* and are bent to provide an inwardly directed biasing force on the blades 70*a*, 70*b*. The force maintains contact between the blades 70*a*, 70*b*, and the bus bar 225 (FIG. 12) of the tracks when the tracks are inserted into the housings 30*a*, 30*b*. Helper springs 64*a*, 64*b* are also located on the neutral blades 60*a*, 60*b* to provide an urging force inwardly toward the trackway 40 of the housings 30*a*, 30*b* in order to maintain contact between the opposite bus bar 226 (FIG. 12) of the track 210 when the tracks 210 are inserted into the trackways 40. The ground contacts 50*a*, 50*b* are also depicted connected to the housing 30*a*, 30*b* respectively.

Figure 8:
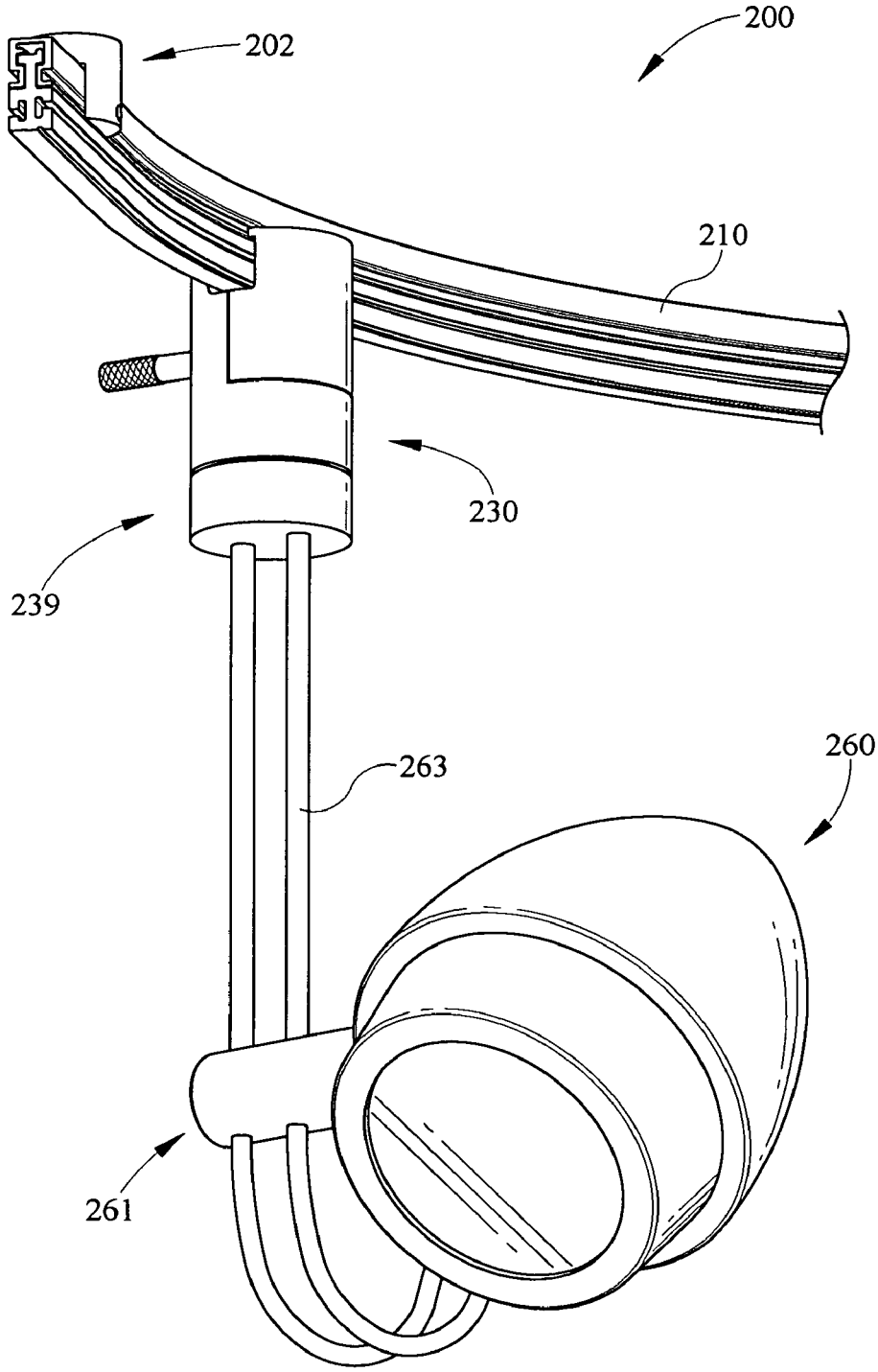
FIG. 8 is a perspective view of surface mount track lighting system.

The joint 20 comprises four cover sections as depicted in FIG. 1. As shown in FIG. 3, the four sections include a joint cover 21, a first housing section 22, a second housing section 23 and a cover section 24. In FIG. 3, the joint cover 21 (FIG. 4) is removed so that sections 22, 23, 24 are shown defining slots there between. Within each of the slots, a pair of leads is positioned so that the leads are spaced apart and do not come in contact so as to short circuit the coupler 10 and track lighting assembly 200 (FIG. 8). The leads 72*a*, 72*b* are disposed above the second joint section 22, and are shown with the cover 21 removed. Likewise, the ground leads 52*a*, 52*b* are disposed between the joint sections 22, 23. Finally, the neutral leads (not shown) are disposed between the sections 23, 24 of the joint 20. However, these positions are merely exemplary and may be moved to alternative slots between alternative sections.

Figure 4:
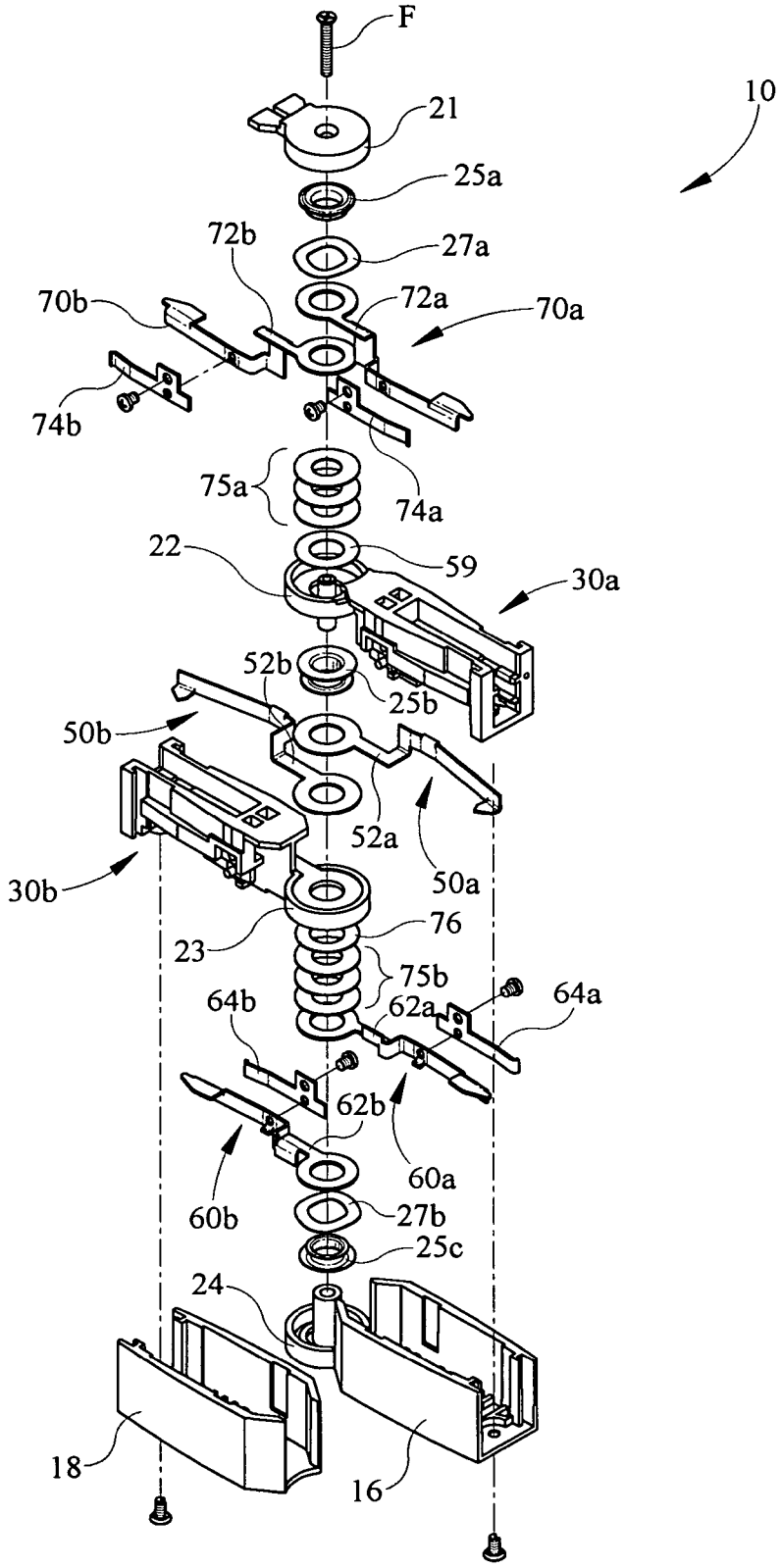
FIG. 4 is an exploded perspective view of the variable angle coupler of FIG. 1.

Referring now to FIG. 4, the variable angle coupler 10 is depicted in exploded perspective view. A fastener F extends through the joint cover 21, the first pivot housing section 22, the second pivot housing section 23, and the cover section 24, so as to fasten the entire coupler 10 together. Various fastener types may be utilized and are therefore within the scope of the present invention. Beneath the joint cover 21 is an eyelet 25*a* which connects contacts 70*a*, 70*b* together as well as a washer 27 within the pivot joint 20, and maintains electrical contact therein. Beneath the eyelet 25*a* is the spring force washer 27. The washer 27 is wavy (non-flat) which causes a force on the components, so as to maintain conductivity between at least the electrical leads 72*a*, 72*b* beneath the washer. Thus, as the coupler 10 is rotated into different positions, the blades 70*a*, 70*b* maintain contact, so as to operate at the various positions in which the first and second connectors 12, 14 may be positioned relative to one another. The blades 70*a*, 70*b* are connected to the leads 72*a*, 72,b which include the circular contacts within the pivot joint 20, which extend generally outward from the circular center portions and depend downwardly to a desired height. Adjacent the blades 70*a*, 70*b* are the helper springs 74*a*, 74*b* which apply a force to the blades in order to maintain contact between the blades 70*a*, 70*b* and the track bus bars 225, 226 (FIG. 12) when the tracks 210 are positioned within the coupler 10. Beneath the eyelet 25*a* is a friction washer 59 and the pivot housing section 22.

Disposed beneath the electrical blades 70*a*, 70*b* are a plurality of insulators 75*a*. In the instant exemplary embodiment three insulators are utilized to provide a preselected thickness or distance between the electrical connection within the coupler, so as to prevent shorting due to crossing polarities. The type of insulation and thickness may be dictated by appropriate electrical codes.

Beneath the pivot section 22 and housing 30*a* which is connected to the housing 30*a* are first and second contacts 50*a*, 50*b*. The exemplary contacts 50*a* and 50*b* of the exemplary embodiment are positioned above the electrical contact 70*a*, 70*b*. The contacts 50*a*, 50*b* comprise leads 52*a*, 52*b* which extend into the central joint 20 of the coupler 10. The leads 52*a*, 52*b* extend upwardly so that the contacts 50*a*, 50*b* are positioned vertically above the other electrical contacts. The contacts 50*a*,50*b* are held together by an eyelet 25*b*. The ground contacts or blades 50*a*, 50*b* engage an upper metal cap portion 214 of the track 210 (FIG. 8), so that the coupler 10 is grounded to the track system 200 (FIG. 8) which is connected to building structure.

Beneath the blades 50*a*, 50*b* is the housing 30*b*, which is connected to the pivot housing section 23. The leads 52*a*, 52*b* are positioned between the pivot housing section 22 and the pivot housing section 23. Beneath the section 23 are a friction washer 76, and a plurality of insulators 75*b*. Beneath the insulators 75*b* are electrical contacts 60*a*, 60*b*. The contacts 60*a*, 60*b* are connected to central circular portions of the leads 62*a*, 62*b* which are positioned in the pivot joint 20. These central portions are disposed vertically between the second pivot housing section 23, and the lower section 24. The contacts 60*a*, 60*b* are forced inwardly by helper springs 64*a*, 64*b*, so as to maintain contact with the appropriate bus bar 225, 226 once the track 210 (FIG. 12) is inserted. Beneath the blades 60*a*, 60*b* is a spring washer 27*b* which also has a wavy form, so as to provide a vertical force to maintain contact between the central circular leads 62*a*, 62*b* in the pivot joint 20. Beneath the washer 27*b* is an eyelet 25*c* to connect the contacts 60*a*,60*b* and the washer 27*b*.

Figure 5:
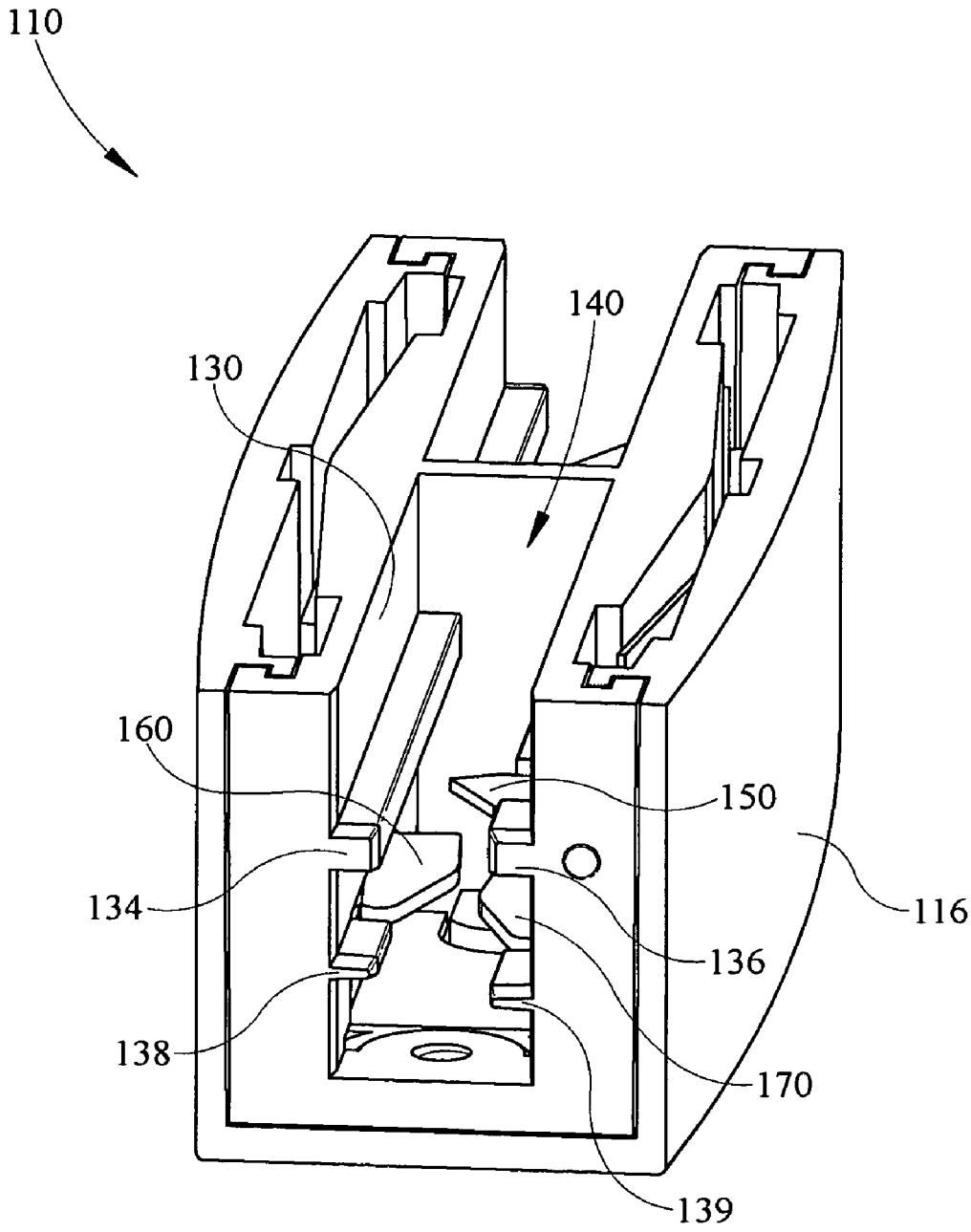
FIG. 5 is a perspective view of an alternative coupler.

Referring now to FIG. 5, an alternative coupler 110 is depicted. The coupler 110 is a ridged coupler for a straight line connection between first and second track portions. The coupler 110 comprises a cover 116 disposed over a housing 130. The housing 130 comprises first and second trackways 140, which are similar, and accordingly a single trackway 140 will be described. The trackway 140 is generally U-shaped when viewed from an end. The vertical walls of the trackway 140 comprise a plurality of keys 134, 136, 138, 139. The first key 134 merely positions the track 210 (FIG. 1) relative to the trackway 140. The second key 136 is interrupted in extending from the trackway opening toward the central portion of the housing 130. In the interrupted area of the key 136 is an electrical blade 150. The blade 150 is a ground blade in the exemplary embodiment. Moving downward vertically, the key 138 is vertically offset from the key 139, so that the adjacent blades 160, 170 respectively are slightly offset from one another. This is a safety precaution in order to maintain proper polarity as previously described. In this embodiment the track 210 (FIG. 1) may be slidably positioned into the trackway 140, so that the ground blade 150 engages an upper track cap, while the blades 160, 170 each engage vertically offset bus bars of the track.

Figure 6:
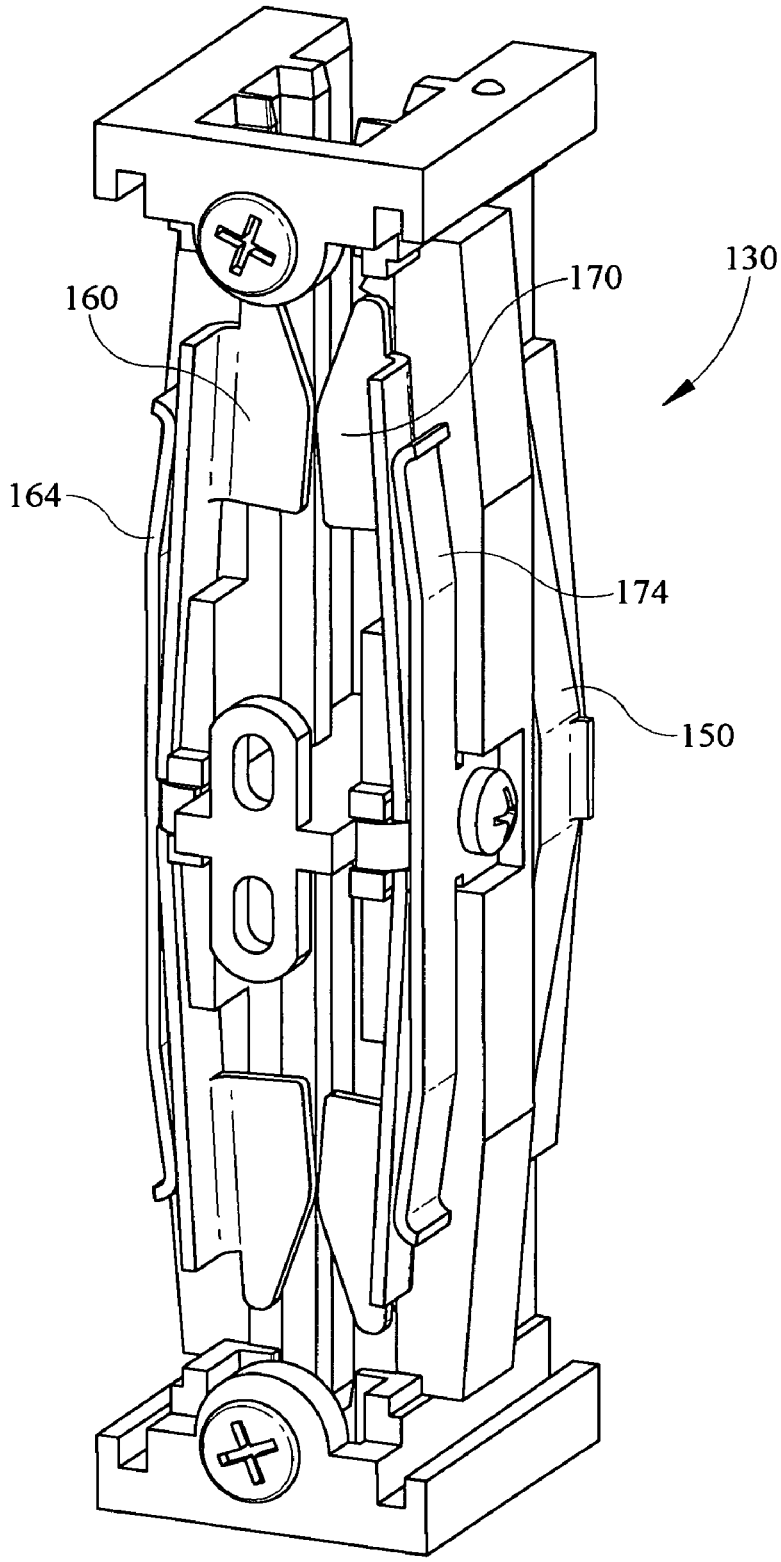
FIG. 6 is a perspective view of the housing of the coupler of FIG. 5 with the cover removed.

The housing 130 is depicted in perspective view in FIG. 6 with the cover 116 removed. In this view, the blades 160, 170 are each engaged by helper springs 164, 174 respectively. The springs 164, 174 force the blades inwardly, so as to maintain contact with the bus bars once the track 210 is inserted. The housing 120 also includes the ground contact 150.

Figure 7:
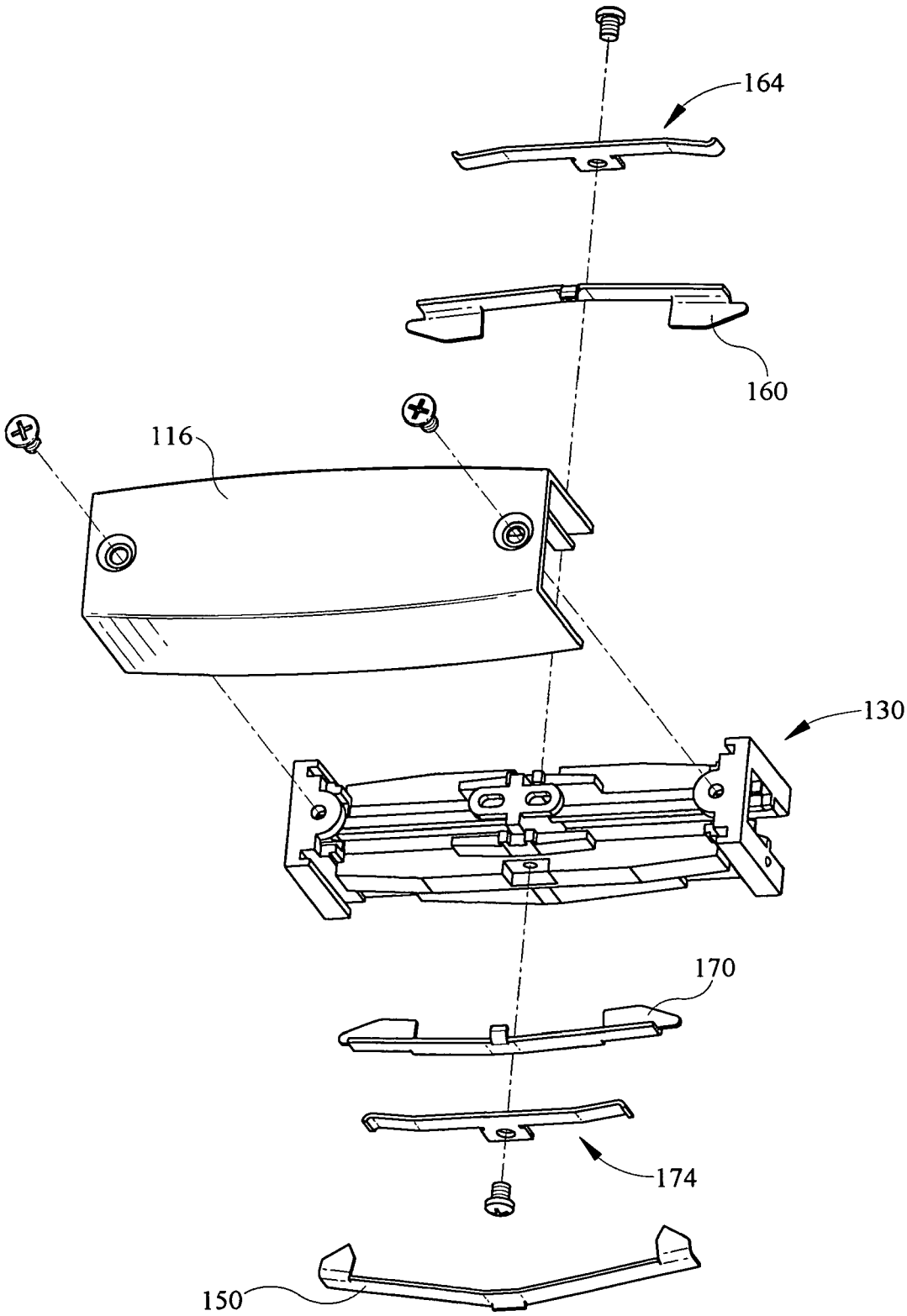
FIG. 7 is an exploded perspective view of the coupler of FIG. 5.

Referring now to FIG. 7, the coupler 110 is depicted in exploded perspective view. The view clearly depicts the fastening connection between the helper spring 164 and the housing, as well as the positioning of the electrical blades 160, 170 within the blade. The ground blade or contact 150 is also depicted. In this view, one can easily see that the blades 150, 160, 170 extend from one end of the coupler 110 to the opposite end, so as to conduct electricity from a first track to a second track (not shown) during operation. Once the contact blades 150, 160, 170 are connected to the housing 130, the cover 116 is applied to the assembly 116.

Referring now to FIG. 8, a perspective view of a track lighting system 200 is depicted. The track lighting system 200 comprises a surface mount ceiling adapter 202, which connects a track 210 to a ceiling. The adapter 202 may allow for the track 210 to be flush mounted against the ceiling surface or depend slightly from the ceiling surface, according to the method of connecting the ceiling adapter 202. Additionally, the ceiling adapter 202 may also be provided with a cable, so that the track 210 may be suspension mounted and depend downwardly from the ceiling some preselected distance, as desired by the lighting designer. Depending from the track 210 is a fixture adapter 230 which connects a fixture 260 to the track 210. The fixture adapter 230 is slidably connected, so as to be moveable along the length of the track 210 regardless of whether the track 210 is flush mounted against the ceiling, spaced from the ceiling some distance, or mounted in a suspended track configuration. The fixture adapter 230 also maintains an electrical connection with the track 210, so that power is continuously provided to the fixture 260, regardless of the position of the fixture 260 along the length of track 210. The track 210 in the exemplary embodiment is depicted as curved however, the track 210 may be straight, curvilinear, or alternatively may be defined by multiple sections of track 210 which are coupled together by a connector, described previously. The fixture adapter 230 provides for pivoting motion about a vertical axis at fixture pivot 239. Depending from the fixture pivot 239 is at least one fixture stem 263. The fixture stem 263 passes through an additional fixture pivot 261 near the fixture 260, which allows for a pivotal motion about a horizontal axis. Thus, the fixture adapter 230 slides along the longitudinal axis of the track 210, and provides for at least pivotal motion about one axis, while second fixture pivot 261 provides for pivoting motion of the fixture 260 about a second axis. The pivoting motion may be provided on the adapter 230 or separately provided as either design is considered within the scope of the present invention. Additionally, fixture 260 shown herein is merely exemplary as alternative fixture designs may be utilized and may depend from the fixture adapter 230, and therefore the fixture 260 should not be considered limiting. For example, pendant fixtures may be utilized, miniature flood lamps, alternative fixture designs, or other lighting mechanisms which may be connected to the fixture adapter 230 for use in the track lighting system 200 may all be utilized, and should be considered within the scope of the present invention.

Figure 9:
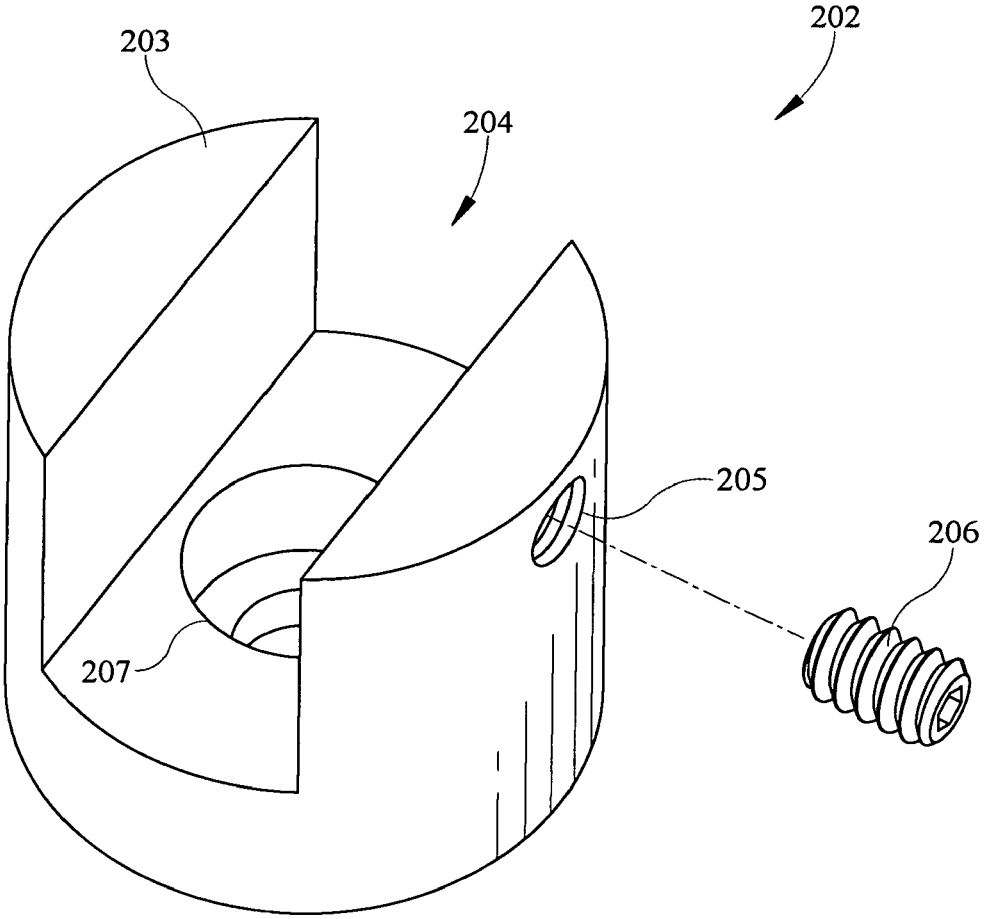
FIG. 9 is a section view of the surface mount track adapter of FIG. 8.

Referring now to FIG. 9, a perspective view of a surface mount ceiling adapter 202 is depicted. The adapter 202 is depicted in an upside-down configuration from its mounted position shown in FIG. 8. The adapter 202 has a body 203 with a central groove or channel 204 extending there through for receiving the track 210. Extending through at least one portion of the body 203 transversely to the channel 204 is a set screw aperture 205. A set screw 206 is positioned in the aperture 205 in order to bear against the track 210 once the track 210 is disposed within the channel 204. Also located within the channel 204 is a central aperture which extends through the body 203 in a vertical direction. The aperture 207 allows the adapter 202 to be fastened to a structural element, such as a ceiling joist or a T-grid member or a ceiling surface. Thus, once the adapter 202 is fastened in place through aperture 207, the track 210 is positioned within the channel 204, and fastened in position with fastener 206. The adapters 202 are positioned along the path of the track, so as to hold the track 210 in the desired position for installation of the remaining track light system.

Figure 10:
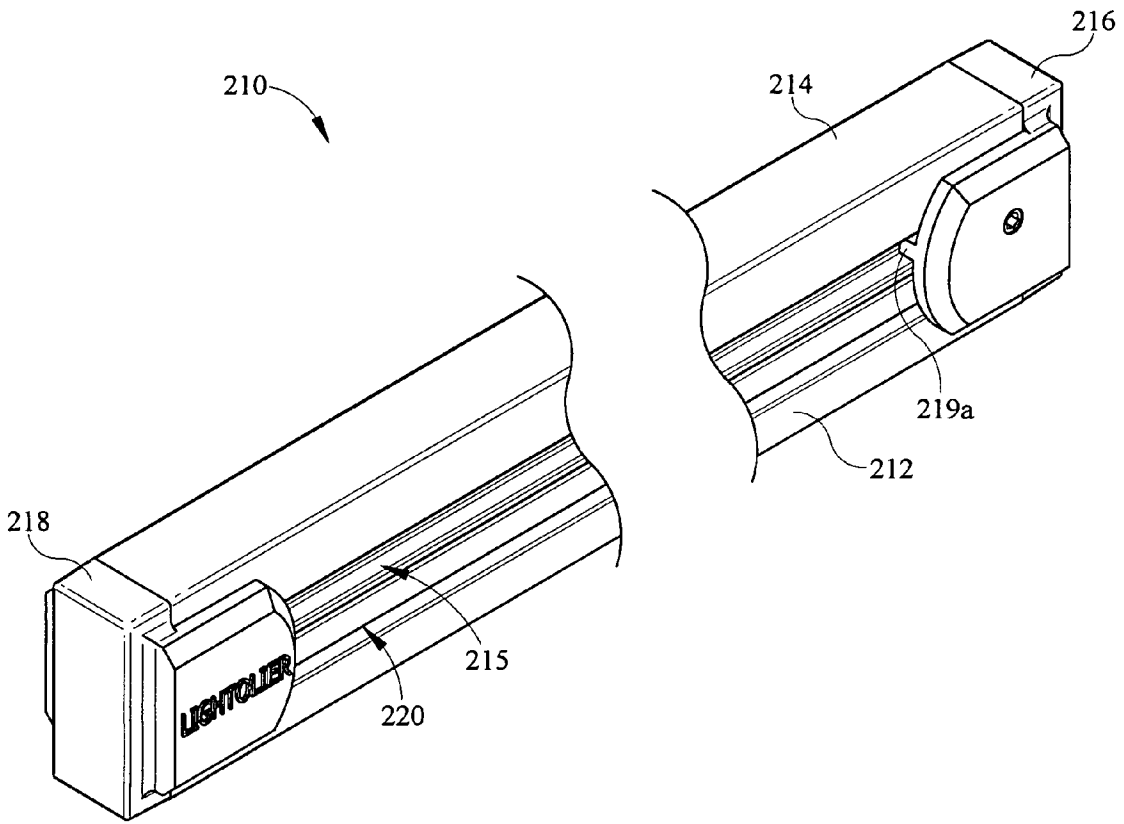
FIG. 10 is a perspective view of a lighting track.

Referring now to FIG. 10, a perspective view of the track 210 is depicted. The track 210 is shown with cut lines extending transversely to a longitudinal axis of the track 210, since the track may be of various lengths from a first end cap 216 to a second end cap 218. The track 210 comprises a polycarbonate body 212, which is generally clear and provides an aesthetically pleasing finish although alternative finishes are within the scope of the present invention. The polycarbonate is utilized for its temperature resistance, insulative properties, and its ability to bend although other materials may be used. Within the track body 12 is a first bus bar groove 220, and an opposed bus bar groove 222 (FIG. 12). Connected to an upper portion of the track body 212 is an upper cap 214, which has a grounding groove 215. The grounding groove 215 receives a grounding blade of the fixture adapter 230 (FIG. 8), and the couplers 10, 110. The upper cap 214 is formed of a metal conductive material, for example extruded aluminum, so that when the ceiling mount adapter 202 is connected to a building structure, the ceiling adapter 202 provides a ground circuit between the track 210, adapter 202 and the building wherein the track lighting system 200 is mounted. Although the upper cap 214 is formed of a metallic material, the upper cap 214 has a cross-sectional shape which allows for some bending with the body 212. The grounding groove 215 also is provided a shape, so as to inhibit vertical removal from the track body 212, but maintains a slidable connection relative to the track body 212, as will be discussed later herein. The upper surface of the cap 214 is flat, so that it may be flush mounted. Each of the end caps 216, 218 comprise keys or fingers 219*a*, which are positioned in the grounding grooves 215. The end caps 216, 218 also comprise fasteners, such as set screws, to tighten the end caps 216, 218 on the track 210 and inhibit sliding of bus bars 225, 226 (FIG. 12) disposed within the grooves 220, 222 from sliding from the track body 212. The end caps 216, 218 also inhibit touching of the bus bars 225, 226 at end locations of the track body 212, where such bus bars may be exposed.

Figure 11:
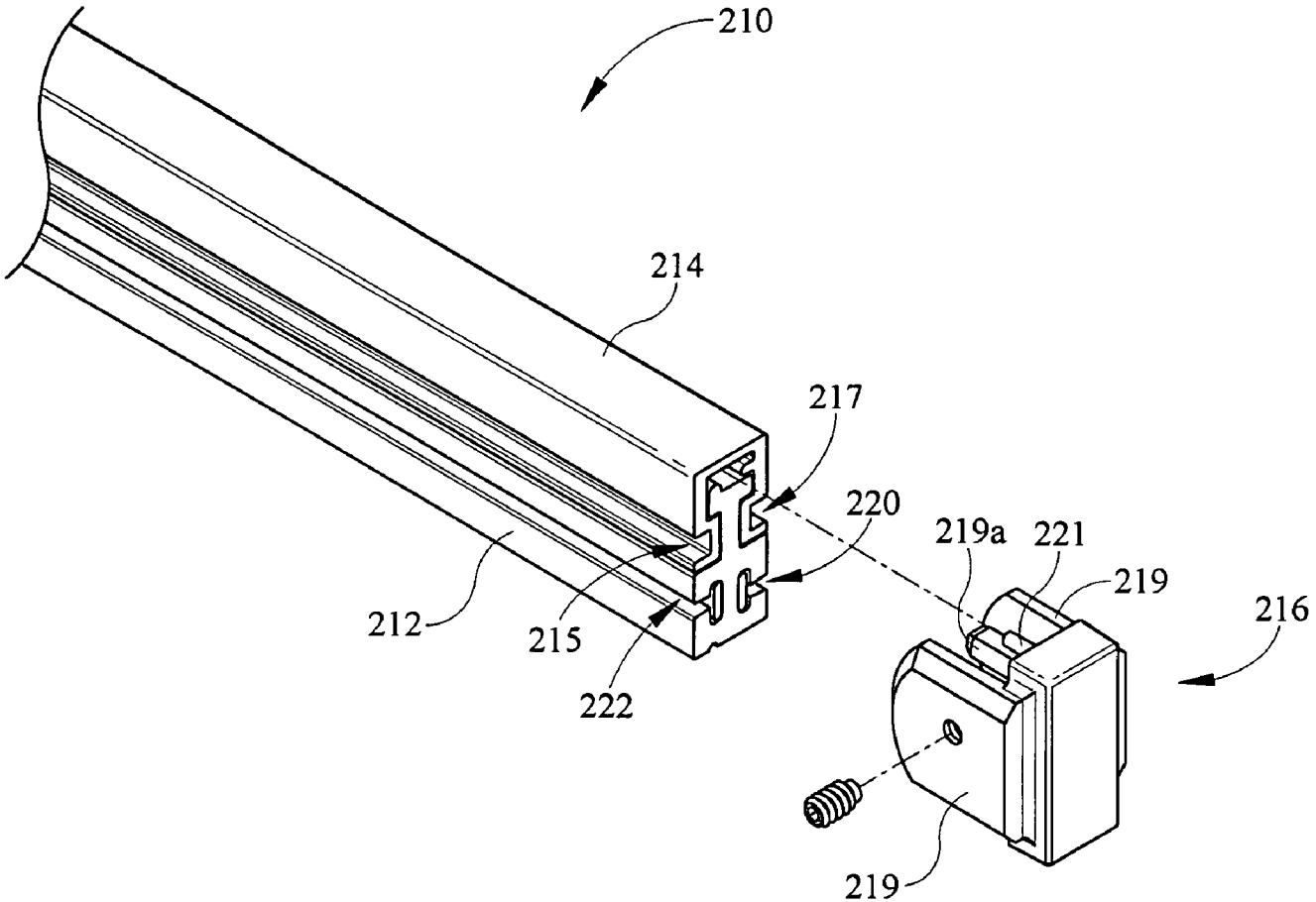
FIG. 11 is a perspective view of the track of FIG. 10, with the end cap exploded.

Referring now to FIG. 11, an end perspective view of the track 210 is depicted. The end cap 216 comprises first and second arms 219 extending from a generally central body, and the first and second keys 219*a*, which are positioned in the ground grooves 215, 217. Accordingly, the grooves 215, 217 act as keyways to receive the end cap 216. The end cap 216 also comprises a nose 221, which is positioned in an opening between the track body 212 and the upper cap 214. This further locates the end caps 216, 218 relative to the track body 212 and upper cap 214.

Referring now to FIG. 12, the track 210 is again depicted in perspective view with the end cap 216 removed, and the end of the track shown more clearly. The track 210 comprises a body 212 and an upper cap 214. The body 212 comprises a first structural shape 223, and a second structural shape 224 in the exemplary embodiment. The first structural shape 223 is generally I-shaped, and extending from the upper surface of the first structural shape 223 is the second structural shape 224, which according to the exemplary embodiment is generally T-shaped. The I-shaped structure 223 has first and second bus bar grooves 220, 222 each having a bus bar 225, 226 respectively therein. The view depicted in FIG. 12 clearly shows that the first groove 220 is vertically offset of the second groove 222. This allows for electrical blades or contacts to be utilized which are also offset and inhibits a track from being connected to a coupler 10, 110, or a fixture adapter 230 from being connected, in a manner that would cross polarity and cause a short-circuit of the track light system 200. With the second structural shape 224 extending upwardly from the first portion 223, the upper cap 214 is formed generally by three U-shaped sections, which extend from the upper surface of the first structural shape and above the upper portion of the second structural shape 224. With this design, the upper cap 214 defines the first and second grounding grooves 215, 217. However, alternative shapes may be utilized. Within an interior portion of the cap 214, a key 227 extends longitudinally to capture the upper cap 214 from above the upper surface of the second structural shape 224, and so that the upper cap 214 may not be removed from the body 212 with a vertical force. Additionally, the key 227 allows the cap 214 to be positioned only in a single orientation. Instead, the upper cap 214 must be slidably removed from the body 212.

Figure 13:
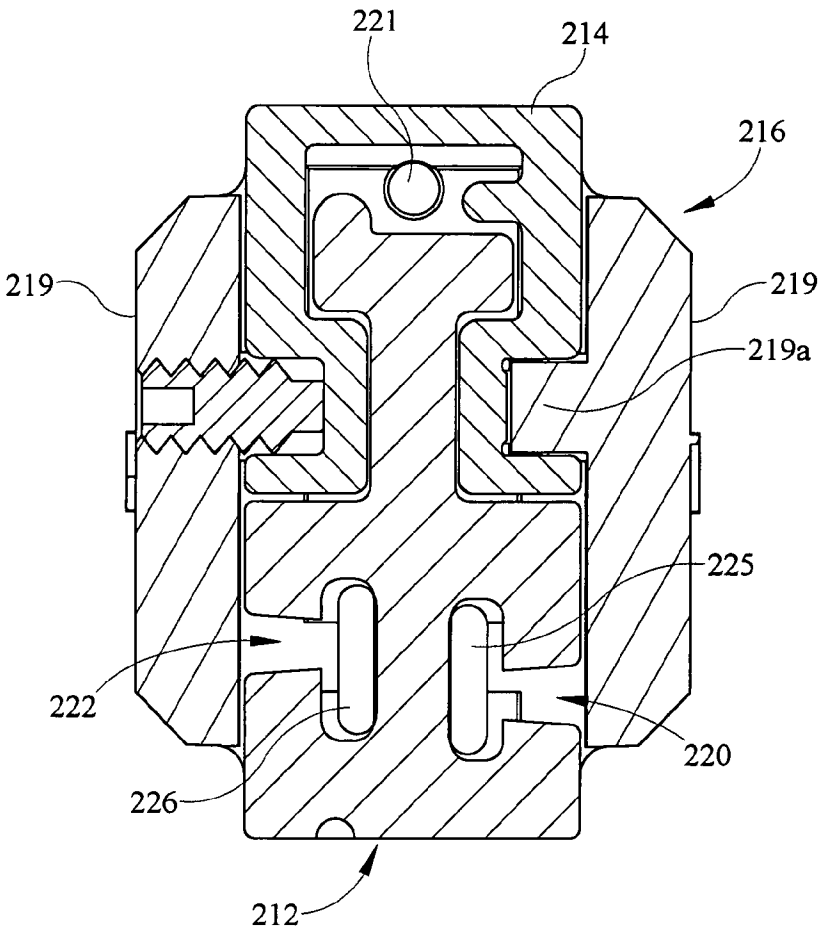
FIG. 13 is a section view of the track and end cap.

Referring to FIG. 13, a section view of the track 210 with the end cap 216 in position is depicted. The section view clearly shows the difference in height in the groove 220 and groove 222. The offset again provides for a means to require adapters and couplers to be positioned on the track in a preselected orientation, so as to inhibit reversal or crossing of polarity which might short-circuit the device. The section view also depicts how a fastener, such as a set screw, extends through the end cap 216 and against the channel 217. Located within the opposite channel 215 is the key 219*a* of the end cap 216.

Figure 14:
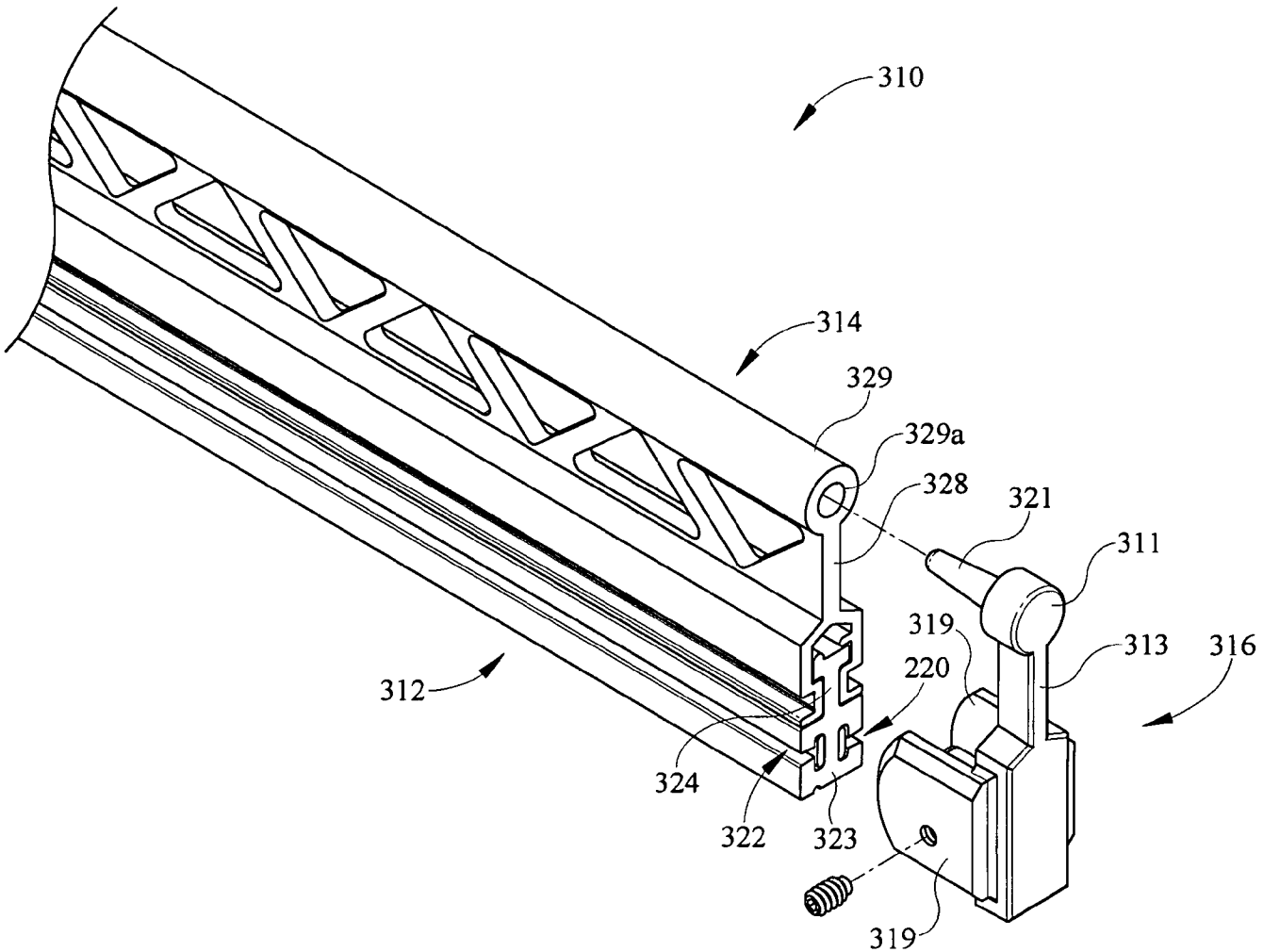
FIG. 14 is a lighting track with an alternative upper cap.
Figure 15:
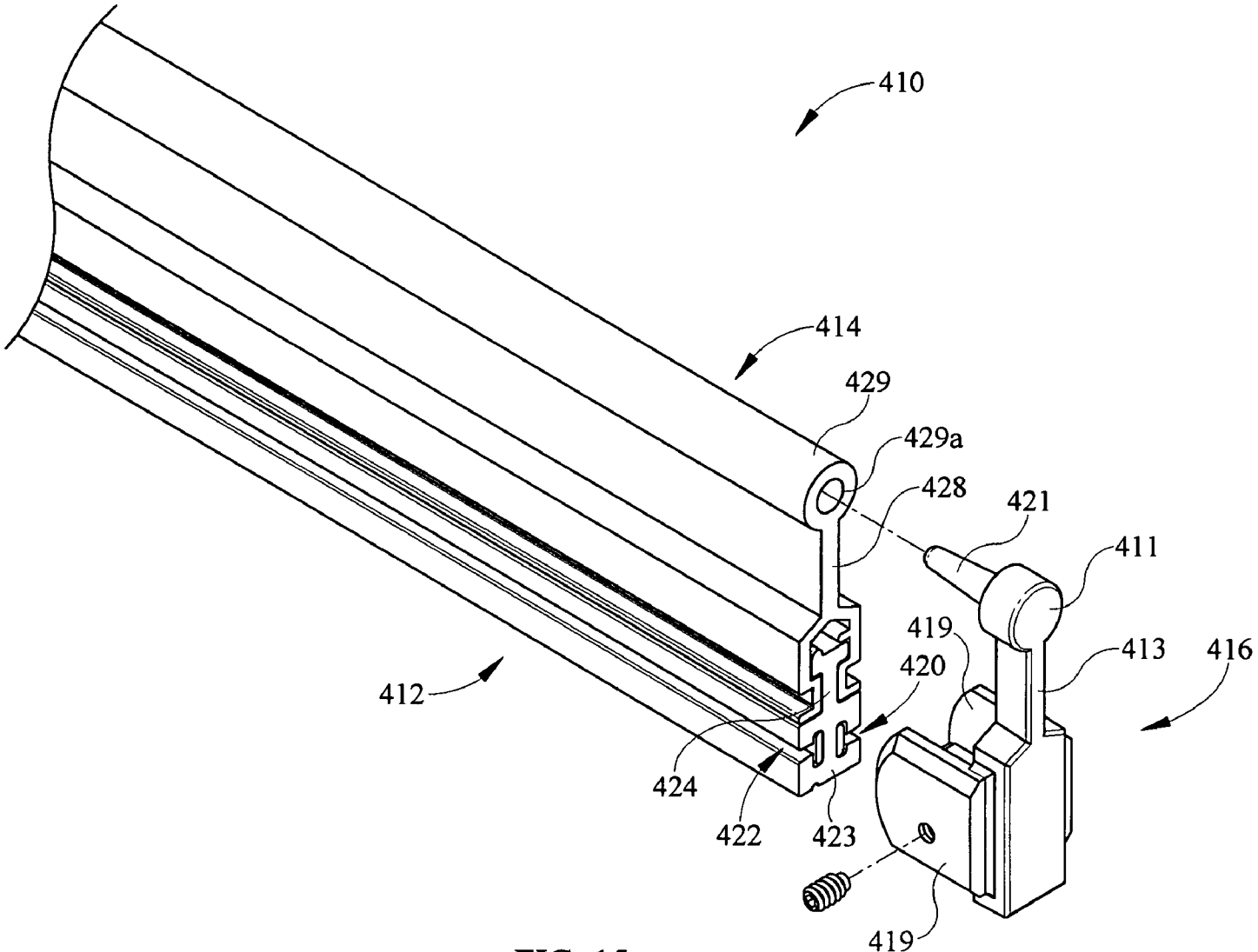
FIG. 15 is a lighting track with a second alternative upper cap.

Referring now to FIG. 14, an alternative track assembly 310 is depicted in perspective view. The track comprises a body 312, which is similar to the body 212 as previously described. The track 310 further comprises an upper cap 314 which is of a differing design than the upper cap 214. The upper cap 314 has a lower portion very similar to the lower portion of upper cap 214 which slidably engages the second structural portion 324 of the body 312. The upper cap further 314 comprises a neck 328 and a head 329 positioned above the neck 328. In the exemplary embodiment, the neck 328 extends the longitudinal direction of the track body 312, and is defined by a truss structure. This is aesthetically pleasing and desirable in certain types of installations. The head 329 comprises a central aperture 329*a* which receives a nose 321 extending from the end cap 316. The end cap 316 utilizes first and second arms 319 and a neck 323 extending from a central body portion of the end cap 316. A head 311 is positioned above the neck 313 and a nose 321 extends from the head 311, and is substantially aligned with the aperture 329*a* of the upper cap 329. The end cap 316 is fastened by a fastener to the upper cap 314 within a grounding groove as previously described. Due to this design, track 310 is not suitable for flush mounting. An alternative embodiment is shown in FIG. 15, which depicts a neck 428 having a solid material design rather than the truss design depicted in FIG. 14. In either embodiment of FIGS. 13, 14, the neck portions extend upwardly unimpeded due to open trackways of the variable angle adapters 10, rigid coupler 110 and fixture adapter 230.

Figure 16:
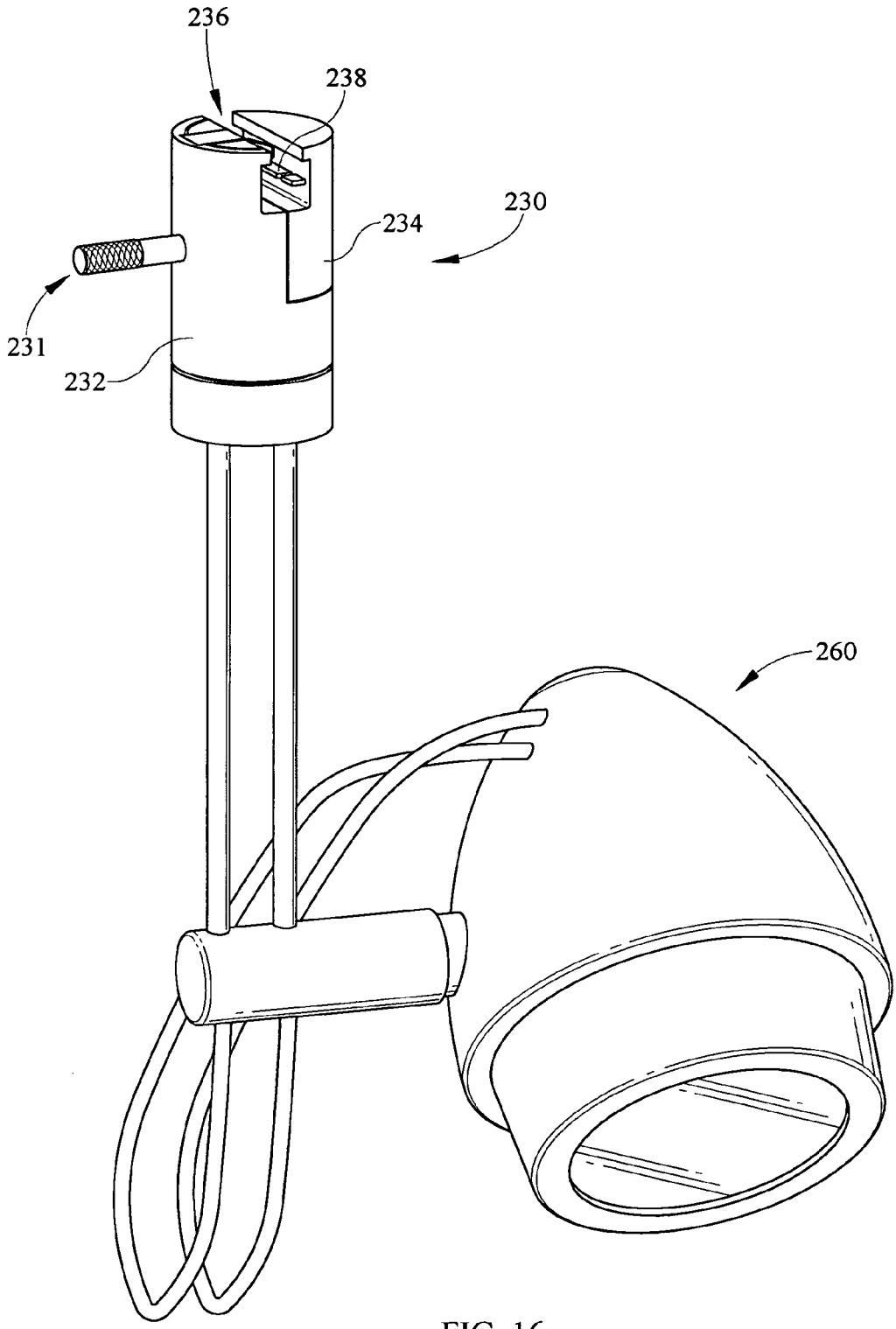
FIG. 16 is a perspective view of a fixture adapter and light fixture.

Referring now to FIG. 16, the fixture adapter 230 and light fixture 260 are shown in perspective view removed from the track 210 of FIG. 8. The fixture adapter 230 comprises a first body portion 232 and a second body portion 234 opposite the first body portion 232, which define a clamping structure for clamping to a track 210, for example. Each of the first and second body portions 232, 234 have a cutout area defining a groove 236 extending through the adapter 230. Within the groove 236 on opposite sides are electrical contact blades 238, 240 and 242. The blades are offset vertically, so as to engage the offset grooves 220, 222. This vertical offset inhibits an installer from positioning the fixture adapter 230 on the track 210 in such a manner as to cross polarity of the adapter 230 and track lighting system 200. The device further comprises a clamping knob 231 which is utilized to open or close the groove 236 into engagement with the track 210.

Figure 17:
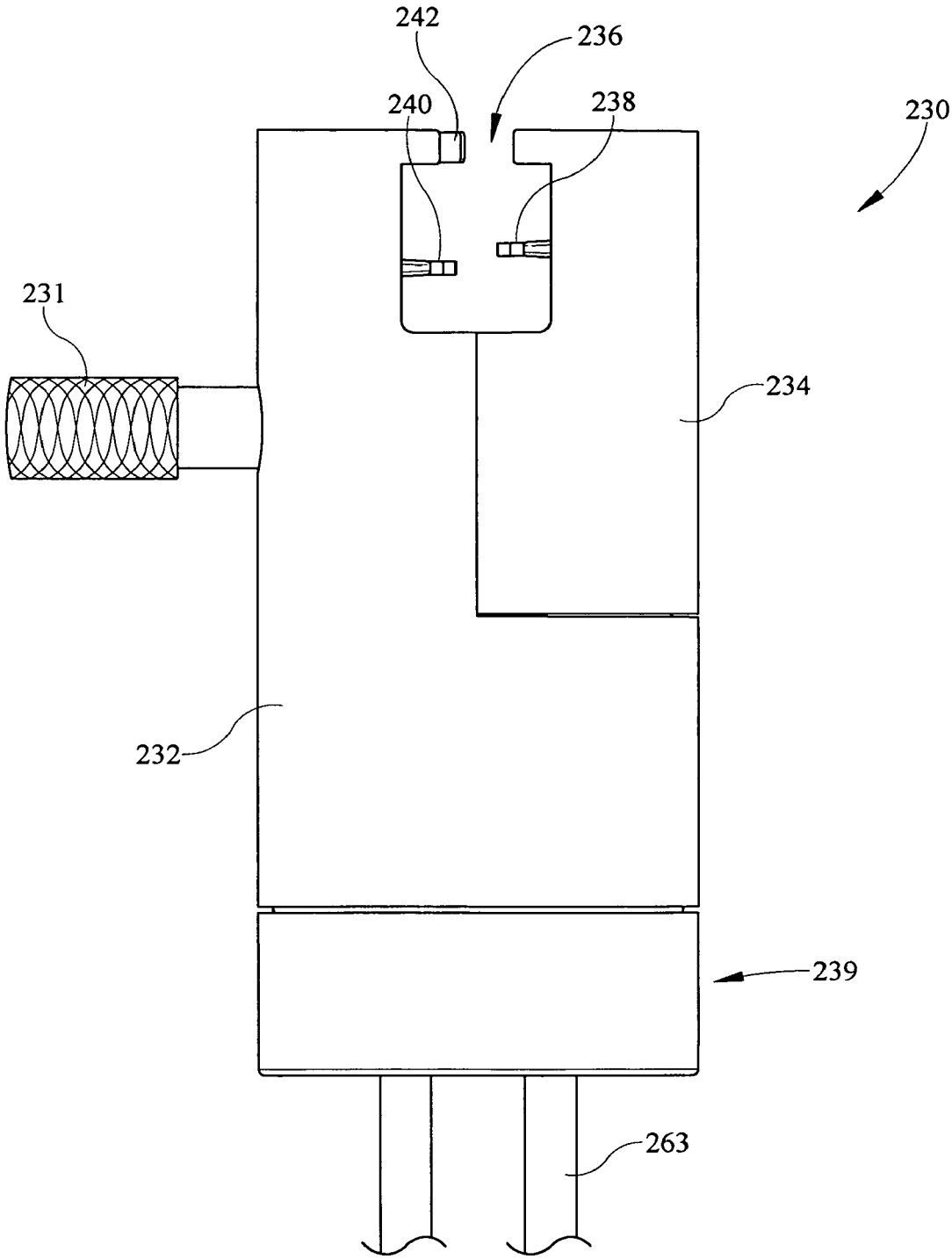
FIG. 17 is an front view of the fixture adapter of FIG. 16.

Referring now to FIG. 17, the fixture adapter 230 is shown in a front view, so that the groove 236 is clearly shown between the first and second adapter housings 232, 234. The groove 236 had a cross-section which is formed to receive the track 210. With the open portion of the groove 236, various cap designs such as upper cap 214, 314, or 414 may be utilized. Within the groove 236, a first blade or contact 238 is depicted vertically offset from the opposed contact or blade 240. At the upper portion of the groove 236 a grounding contact 242 is also depicted. The three blades or contacts 238, 240, 242 provide the electrical conductivity between the fixture adapter 230 and track 210 (FIG. 12). The clamping knob 231 is rotatable so as to open the groove 236 horizontally, allowing placement of the track 210 within the groove 236.

Figure 18:
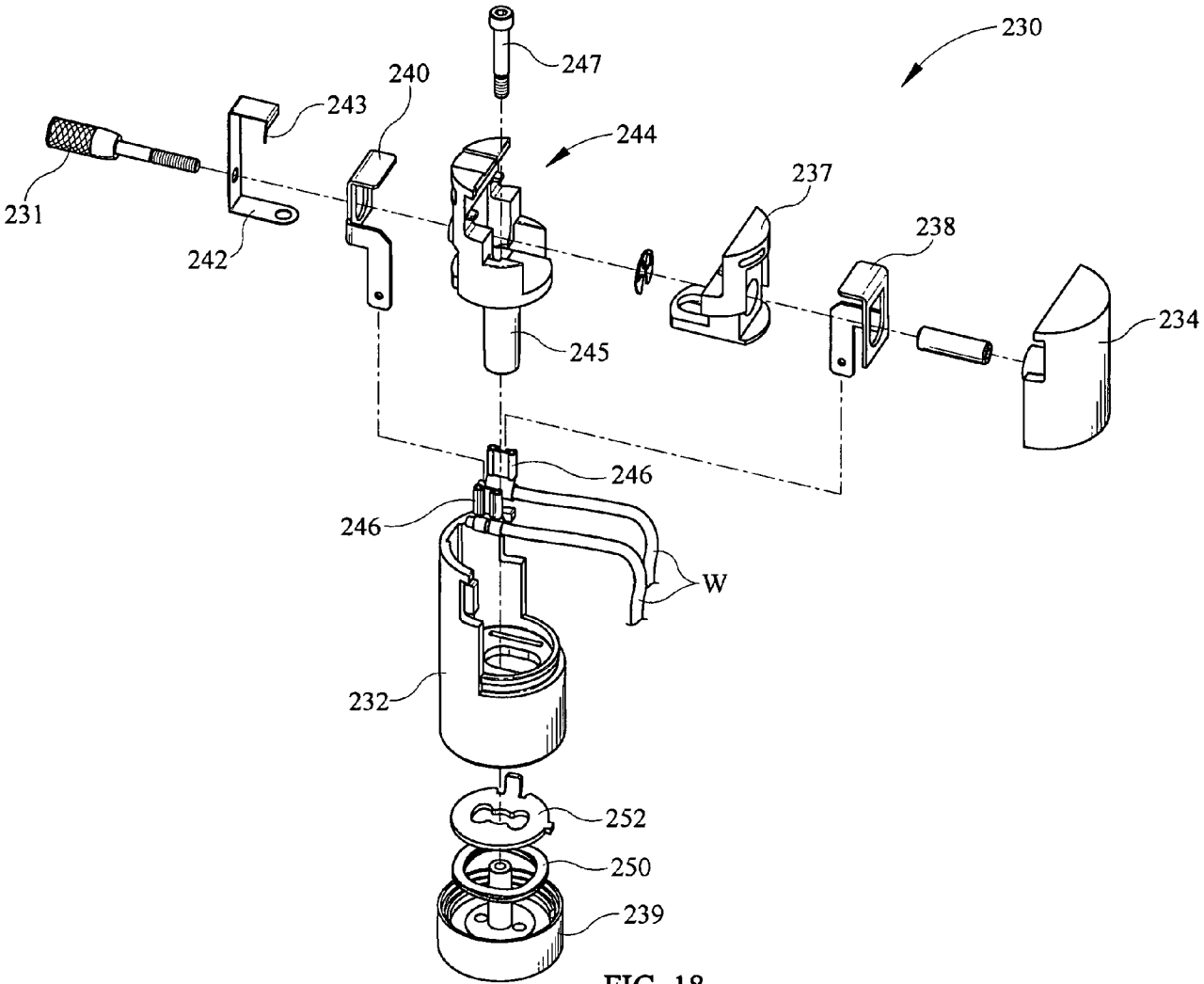
FIG. 18 is an exploded perspective view of the fixture adapter.

Referring now to FIG. 18, the adapter 230 is depicted in an exploded perspective view. The fixture adapter 230 includes a first housing clamp 232 and an opposed second housing clamp 234 which when seated together have a generally cylindrical shape and define the groove 236. Although the shape of the fixture adapter 230 is generally cylindrical in shape, alternative shapes may be utilized as the cylindrical shape is merely aesthetically pleasing and matches the décor of the track lighting system 210. With the housing portions 232, 234 exploded, a contact holder 244 is depicted. The contact holder 244 has a circular cross-section with an upper portion to hold track contacts 240 and ground contact 242. A corresponding contact holder 234 is disposed within the contact holder 244 to receive the opposite track contact 238. The contact holder 234 has a central channel which receives the opposite contact holder 234 and is formed with shelves which slidably receive the opposed contact holder 234. The clamping knob 231 has a threaded end which passes through the ground spring 244, track contact 240, contact holder 244 and has an E-clip connected thereto. The threaded end engages a threaded insert 246 which is molded into the second clamp housing 244. As a knurled end is rotated by a user, the threaded end causes the second housing 234 and insert to spread or open.

Beneath the contact holder 244 are first and second female disconnects 246. Each of the disconnects is engaged with a track contact 238, 240. Wires W extending from the disconnects extend downwardly through the housing clamp 232 and into the stems 263 (FIG. 16). These wires provide power to the fixture 260 from the fixture adapter 230.

Beneath the first housing clamp 232 and second housing clamp 234 is the pivot base 239. The pivot base 239 has a stem extending upwardly through the housing clamp 232 and engaging a stem 245 extending beneath the contact holder. An adapter fastener 247 extends through the contact holder 244, first housing clamp and a stem of the pivot base 239 to fasten the entire assembly together. Between the clamp 232 and pivot base 239 is a spring force washer 250 which provides force for the rotation of the pivot base 239 relative to the first housing clamp 232. The washer 250 is generally wavy rather than flat to provide such force. Above the washer 250 is a kick stop washer 252 which rotates relative to the first housing clamp 232 some preselected distance and allows for rotation of the pivot base 239 some additional rotation. Accordingly, the pivot base 239 can move relative to the first housing clamp 232 through an arcuate distance of about 360 degrees.

Beneath the fixture adapter 230 are stems 263 and the fixture 260. The stems 263 provide access for wiring to the fixture 260 from the adapter 230. The fixture 260 may comprise various aesthetic designs and may have lights of line voltage or low voltage. For example, low voltage halogen MR16, AR111 and T4 lamps may be used with a transformer to step down the line voltage track. Alternatively, line voltage MR16 and T4 lamps may be used.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A track lighting assembly, comprising:

a first track member;

a second track member;

a coupler positioned between said first track member and said second track member;

said coupler having a first trackway for receiving a first track member and a second trackway for receiving a second track member;

said coupler having a first side adjacent a first side of said first and second track members, a second side adjacent a second side of said first and second track members and a lower side disposed along a lower surface of said first and second track members;

wherein both said first trackway and said second trackway of said coupler have an upper portion which is open allowing said track members to have various structural shapes;

said coupler having a joint disposed between a first connector and a second connector of said coupler allowing pivotal motion between said first track member and said second track member.

2. The track lighting member of claim 1, said coupler allowing rotation between said first track member and said second track member of between about 60 degrees and about 300 degrees.

3. The track lighting assembly of claim 1, said coupler further comprising first and second offset blades in the vertical direction.

4. The track lighting assembly of claim 1, said first and second housings each having a housing cover including an open upper area.

5. The track lighting assembly of claim 1, said first and second housings having keys for insertion of said first track member and said second track member in a preselected orientation.

6. The track lighting assembly of claim 1, said coupler further comprising a ground blade.

7. The track lighting assembly of claim 1, said first trackway and said second trackway being substantially U-shaped.

8. The track lighting assembly of claim 1 wherein an upper surface of each said first and second track members is substantially flush with an upper surface of said coupler.

9. The track lighting assembly of claim 1, said coupler being a rigid straight orientation between said first track member and said second track member.

10. The track lighting assembly of claim 1, said track members each having vertically offset bus bars.

11. The track lighting assembly of claim 1, said joint further comprising a plurality of circular leads in electrical communication with blades within said first housing and said second housing.

12. The track lighting assembly of claim 11, further comprising two of said circular leads engaging for each of a hot circuit, neutral circuit and a ground circuit.

13. The track lighting assembly of claim 12, said hot circuit, said neutral circuit and said ground circuit being at different elevations within said trackway.

14. The track lighting assembly of claim 1, said coupler joint further comprising a pivot assembly.

15. The track lighting assembly of claim 14, said pivot assembly providing a range of motion between said first track member and said second track member of between about 60 degrees and about 300 degrees.

16. The track lighting assembly of claim 14, said pivot assembly being wire-free.

17. The track lighting assembly of claim 14, said pivot assembly further comprising wireless electrical junction for each of the three circuits.

18. A coupler for a track lighting assembly, comprising:

a first housing and a second housing;

a joint disposed between said first housing and said second housing;

said first housing having a first trackway for receiving a first track member and said second housing having a second trackway for receiving a second track member;

wherein both said first trackway and said second trackway have an upper portion which is open allowing said track members to have various structural shapes;

said joint having a wireless electrically conductive rotatable assembly therein for electrical communication between said first housing and said second housing;

said first housing movable relative to said second housing about an axis extending through said joint;

wherein each of said first trackway and said second trackway have at least one key;

said at least one key being a first key and a second key;

said first key and said second key being offset in a vertical direction.

19. The coupler of claim 18 further comprising a hot blade, a neutral blade and a ground blade.

20. The coupler of claim 19, said ground blade disposed for contact with a track cap.

21. A coupler for a track lighting assembly, comprising:

a first track housing;

a second track housing pivotally coupled to said first track housing by an electrically conductive joint;

said first and second housings having a hot conductive circuit, a neutral conductive circuit and a ground conductive circuit;

at least one blade corresponding to each of said circuits in each of said housings, said blades being vertically offset for maintaining proper polarity across said coupler;

wherein the electrical communication between ends of said blades is maintained across said electrically conductive joint;

wherein both said first track housing and said second track housing have an upper portion which is open allowing mating track members to have various structural shapes.

* * * * *